US010701770B2

(12) United States Patent
Jang et al.

(10) Patent No.: US 10,701,770 B2
(45) Date of Patent: Jun. 30, 2020

(54) COOKING DEVICE

(71) Applicant: Samsung Electronics Co., Ltd., Gyeonggi-do (KR)

(72) Inventors: Hyeong Jin Jang, Seoul (KR); Tae Hun Kim, Seoul (KR); In Ki Jeon, Hwaseong-si (KR); Kun Woo Choi, Yongin-si (KR); Yu Jeub Ha, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 286 days.

(21) Appl. No.: 15/577,297

(22) PCT Filed: May 18, 2016

(86) PCT No.: PCT/KR2016/005226
§ 371 (c)(1),
(2) Date: Nov. 27, 2017

(87) PCT Pub. No.: WO2016/190589
PCT Pub. Date: Dec. 1, 2016

(65) Prior Publication Data

US 2018/0153004 A1 May 31, 2018

(30) Foreign Application Priority Data

May 27, 2015 (KR) ..... 10-2015-0073775

(51) Int. Cl.
*H05B 6/76* (2006.01)
*H05B 6/64* (2006.01)
*F24C 15/04* (2006.01)

(52) U.S. Cl.
CPC ..... *H05B 6/766* (2013.01); *H05B 6/6414* (2013.01); *H05B 6/763* (2013.01); *F24C 15/04* (2013.01); *H05B 6/6417* (2013.01)

(58) Field of Classification Search
CPC ..... F24C 15/04; F24C 15/028; F24C 15/021; F24C 15/02; H05B 6/76; H05B 6/763;
(Continued)

(56) References Cited

U.S. PATENT DOCUMENTS 3,679,855 A * 7/1972 Binzer ..... H05B 6/6414 219/740
3,956,608 A * 5/1976 Imberg ..... H05B 6/763 219/741
(Continued)

FOREIGN PATENT DOCUMENTS

CN 1309266 A 8/2001
CN 1528106 A 9/2004
(Continued)

OTHER PUBLICATIONS

Communication from a foreign patent office in a counterpart foreign application, European Patent Office, "Supplementary European Search Report," Application No. EP 168002293, dated May 14, 2018, 7 pages.
(Continued)

*Primary Examiner* — Patrick M. Buechner

(57) ABSTRACT

A cooking appliance with an improved structure to increase visibility to get a better look at the inside of a cooking room during cooking while blocking electromagnetic waves generated in the cooking room from leaking out. The cooking appliance includes a main body configured to have having a cooking room and a door arranged on the front of the main body to open or and close the cooking room. The door includes a door frame configured to have an opening formed to see into the cooking room and a conductive border portion around the opening; a shielding member arranged to cover the opening and having a conductive blocking layer configured to block electromagnetic waves; and a fixing member
(Continued)

arranged to combine the door frame and the shielding member.

12 Claims, 29 Drawing Sheets

(58) Field of Classification Search
CPC .... H05B 6/766; H05B 6/6414; H05B 6/6408; H05B 6/6426
See application file for complete search history.

(56) References Cited

U.S. PATENT DOCUMENTS 3,985,993 A * 10/1976 Imberg ..... H05B 6/763 219/741
4,008,383 A * 2/1977 Tanaka ..... H05B 6/763 219/740
4,102,041 A * 7/1978 Copping ..... H05B 6/763 219/742
4,215,258 A 7/1980 Nelson et al.
RE31,637 E * 7/1984 Yoshida ..... F24C 15/322 126/273 R
4,523,069 A * 6/1985 Staats ..... H05B 6/763 174/361
4,577,079 A * 3/1986 Sujaku ..... H05B 6/763 126/198
4,609,800 A * 9/1986 Sakoda ..... H05B 6/763 126/200
4,609,801 A * 9/1986 Spencer ..... H05B 6/6426 126/273 R
4,613,530 A 9/1986 Hood et al.
5,146,059 A * 9/1992 Seog Tae ..... C03C 17/09 174/381
5,824,999 A * 10/1998 Kim ..... H05B 6/763 219/742
5,973,305 A * 10/1999 Kim ..... H05B 6/763 219/742
6,822,208 B2 11/2004 Henze et al.
7,053,348 B1 * 5/2006 Terada ..... H05B 6/763 126/198
2001/0009256 A1 7/2001 Nasu et al.
2001/0030185 A1 * 10/2001 Schnabel ..... H01L 23/13 219/446.1
2003/0168447 A1 9/2003 Lee
2004/0164075 A1 * 8/2004 Henze ..... F24C 15/04 219/740
2004/0206753 A1 10/2004 Schaupert
2005/0023277 A1 * 2/2005 Kim ..... H05B 6/6414 219/739
2005/0056639 A1 * 3/2005 Hu ..... H05B 6/763 219/739
2005/0067412 A1 * 3/2005 Kim ..... H05B 6/6414 219/743
2005/0072777 A1 * 4/2005 Kim ..... H05B 6/763 219/741
2007/0271847 A1 11/2007 Chin
2008/0134903 A1 6/2008 Kim et al.
2013/0019854 A1 1/2013 Lim et al.
2017/0245680 A1 * 8/2017 Kim ..... A47J 27/002
2018/0054860 A1 * 2/2018 Kim ..... B23P 19/00
2018/0153004 A1 * 5/2018 Jang ..... H05B 6/6417
2019/0014626 A1 * 1/2019 Ha ..... H05B 6/763
2019/0021145 A1 * 1/2019 Ha ..... H05B 6/763

FOREIGN PATENT DOCUMENTS

CN 101081144 A 12/2007
CN 101529165 A 9/2009
EP 1450584 A1 8/2004
JP 2002-93571 A 3/2002
KR 100366021 B1 12/2002
KR 100395640 B1 8/2003
KR 20040090786 A 10/2004
KR 100774505 B1 11/2007
KR 101273825 B1 6/2013

OTHER PUBLICATIONS

Office Action dated Jul. 30, 2019 in connection with Chinese Patent Application No. 201680030565.1, 10 pages.
Communication pursuant to Article 94(3) EPC dated Apr. 25, 2019 in connection with European Patent Application No. 16 800 229.3, 6 pages.
State Intellectual Property Office of the People's Republic of China, "The First Office Action," Application No. CN 201680030565.1, dated Dec. 29, 2018, 16 pages.
European Patent Office, Communication pursuant to Article 94(3) EPC dated Mar. 17, 2020 in connection with Patent Application No. 16800229.3, 6 pages.

* cited by examiner

COOKING DEVICE

CROSS-REFERENCE TO RELATED APPLICATIONS AND CLAIM OF PRIORITY

The present application claims priority under 35 U.S.C. § 365 to International Patent Application No. PCT/KR2016/005226 filed May 18, 2016, entitled "COOKING DEVICE", and through Korean Patent Application No. 10-2015-0073775 filed on May 27, 2015, each of which are incorporated herein by reference into the present disclosure as if fully set forth herein.

TECHNICAL FIELD

The present disclosure relates to a cooking appliance, and more particularly, to a cooking appliance with an improved structure to increase visibility to get a better look at the inside of a cooking room during cooking while blocking electromagnetic waves generated in the cooking room from leaking out.

BACKGROUND

Microwaves are cooking appliances to heat food using the nature of electromagnetic waves called micro waves. The microwave heats food by producing heat from inside the food according to a dielectric heating method.

When an electromagnetic wave with a high frequency collides with food, water molecules inside the food are spinning and accordingly, molecular arrangement of the food becomes in disorder. The microwave heats food using heat produced when the water molecules are spinning.

In general, it is hard to see into the cooking room of the microwave during cooking, so one has to open the door and check the cooking process to know of the detailed cooking process.

SUMMARY

The present disclosure provides a cooking appliance having a door of an improved structure to increase visibility to get a better look at the inside of a cooking room during cooking.

The present disclosure also provides a method for fixing a shielding member with which to get a better look at the inside of the cooking room while blocking electromagnetic waves produced inside the cooking room from leaking out onto the door.

In accordance with one aspect to the present disclosure, a cooking appliance includes a main body having a cooking room and a door arranged on a front of the main body and configured to open or and close the cooking room. The door may include a door frame having an opening formed to see into the cooking room and a conductive border portion around the opening; a shielding member arranged to cover the opening and having a conductive blocking layer configured to block electromagnetic waves; and a fixing member arranged to combine the door frame and the shielding member. The shielding member may be arranged in a manner that the blocking layer joins the border portion of the door frame to be electrically connected.

The shielding member may have the blocking layer formed with a conductive material to block electromagnetic waves applied onto a transparent plastic film or panel.

The shielding member may have the blocking layer formed with a conductive material to block electromagnetic waves applied onto a transparent glass film or panel.

The fixing member may be arranged to be combined with the door frame with the shielding member interposed.

The fixing member may be formed in a figure corresponding to the border portion of the door frame and include a coupling portion combined with the door frame. The door frame may include a coupled portion arranged in the border portion and combined with the coupling portion of the fixing member.

A plurality of coupling portions of the fixing member may be arranged along the border portion of the door frame where the shielding member and the door frame join, and an interval between the coupling portions is equal to or less than 50 mm.

The coupling portion of the fixing member may include a burring portion having a burring hole and a side wall surrounding the burring hole and extending to the shielding member perpendicularly to the fixing member. The shielding member may include a through hole formed for the burring portion to pass through to be combined with the coupled portion of the door frame. The coupled portion of the door frame may include a through hole formed for the boning portion to pass through.

The burring portion of the fixing member may penetrate the through holes formed in the shielding member and the door frame. The side wall of the burring portion penetrating and protruding from the through hole may be bent outward in the radial direction of the burring hole to form a curling portion.

The coupling portion of the fixing member may include a welding projection protruding to the shielding member perpendicularly to the fixing member to enable a welding position to be checked, and to be combined with the coupled portion of the door frame. The shielding member may include a through hole formed for the welding projection to pass through to be combined with the coupled portion of the door frame. The coupled portion of the door frame may include a conductive welded portion allowing the welding projection to be welded.

The coupling portion of the fixing member may include a pressing portion configured to apply pressure toward the shielding member perpendicularly the fixing member to be combined with the coupled portion of the door frame. The shielding member may include a through hole formed for the pressing portion to pass through to be combined with the coupled portion of the door frame. The coupled portion of the door frame may include a pressed portion pressed with the pressing portion of the fixing member.

The door may include at least one screen to protect the shielding member. The at least one screen may include a first screen arranged to cover the coupling portion of the fixing member.

The at least one screen may include a second screen arranged on the opposite side of the shielding member from the door frame to protect a side of the shielding member, on which the first screen is not arranged.

In accordance with another aspect of the present disclosure, a cooking appliance includes: a main body configured to have a cooking room; and a door arranged on the front of the main body to open or close the cooking room. The door may include a door frame configured to have an opening formed to see into the cooking room and a conductive border portion around the opening; a shielding member arranged to cover the opening and having a conductive blocking layer configured to block electromagnetic waves; and a fixing member arranged between the door frame and the shielding member to fix the shielding member to the door frame. The shielding member may be arranged such that the blocking layer is directed to the door frame and electrically connected to the border portion of the door frame.

The fixing member may be formed of a conductive material, including conductive layers on the sides of the shielding member and the door frame, and may be arranged on the border portion of the door frame.

The door may include at least one screen to protect the shielding member. The at least one screen may include a first screen arranged on the opposite side of the fixing member from the shielding member.

The at least one screen may include a second screen arranged on the opposite side of the shielding member from the door frame to protect a side of the shielding member, on which the first screen is not arranged.

In accordance with another aspect of the present disclosure, a cooking appliance includes a main body configured to have a cooking room and a door arranged on the front of the main body to open and close the cooking room and equipped with a visible window through which to look into the cooking room. The door may include a casing forming the exterior of the door, a door frame arranged inside the casing and having an opening corresponding to the visible window and a conductive border portion around the opening, a blocking layer formed with a conductive material applied thereon to block electromagnetic waves, at least one shielding member arranged for the blocking layer to face the door frame to cover the opening and electrically connected to the door frame, and at least one fixing member formed in a figure corresponding to the border portion of the door frame, and configured to fix the shielding member to the door frame and to secure electrical connection between the shielding member and the door frame.

The at least one shielding member may be arranged between the cooking room and the door frame.

The at least one shielding member may be arranged between the door frame and the casing.

The door may further include at least one screen to protect the at least one shielding member. The at least one screen may include a first screen arranged between the at least one shielding member and the cooking room.

The at least one screen may include a second screen arranged between the door frame and the casing.

In accordance with another aspect of the present disclosure, a cooking appliance includes a main body configured to have a cooking room and a door arranged on the front of the main body to open and close the cooking room and equipped with a visible window through which to look into the cooking room. The door may include a casing forming the exterior of the door, a door frame arranged inside the casing and having an opening corresponding to the visible window and a conductive border portion around the opening, a shielding member arranged to cover the opening and having a conductive blocking layer configured to block electromagnetic waves, a fixing member arranged between the door frame and the shielding member to fix the shielding member to the door frame, a first auxiliary fixing member configured to fix the shielding member to the door frame and installed on the door frame, and a second auxiliary fixing member coupled with the first auxiliary fixing member to fix the shielding member to the door frame.

The shielding member may be arranged such that the shielding member is directed to the fixing member. The fixing member may be formed of a conductive material, including conductive layers on the sides of the shielding member and the door frame, and may be arranged on the border portion of the door frame.

The first auxiliary fixing member may be installed in a bending portion that extends from the border portion of the door frame, and may be combined with the second auxiliary fixing member to press the shielding member and the fixing member toward the border portion of the door frame.

The door may further include a fixing screw to combine the first and second auxiliary fixing members. The first and second auxiliary fixing members may each have a through hole for the fixing screw to pass through.

The door may include at least one screen to protect the shielding member.

The at least one screen may include a first screen arranged between the door frame and the cooking room.

The at least one screen may include a second screen arranged between the door frame and the casing.

One of the at least one screen arranged on the side where the shielding member is arranged may be fixed to the door frame by the first and second auxiliary fixing members.

In accordance with another aspect of the present disclosure, a cooking appliance includes a main body configured to have a cooking room and a door arranged on the front of the main body to open and close the cooking room and equipped with a visible window through which to look into the cooking room. The door may include a casing forming the exterior of the door, a door frame arranged inside the casing and having an opening corresponding to the visible window and a conductive border portion around the opening, a conductive blocking layer configured to block electromagnetic waves, a shielding member arranged for the blocking layer to face the door frame to cover the opening and electrically connected to the door frame, and a screen arranged to be combined with the door frame with the shielding member in between to protect the shielding member.

The door may further include a buffering member arranged between the shielding member and the screen.

The buffering member may include adhesive layers on the side of the shielding member and on the side of the screen.

The shielding member and the screen may be arranged on the side of the cooking room of the door frame.

The shielding member and the screen may be arranged on the side of the casing of the door frame.

The door may further include an extra screen on the side of the cooking room of the door frame.

According to the aforementioned cooking appliance, a shielding member may prevent leakage of electromagnetic waves and make the inside of a cooking room seen well without need to open the door during cooking.

Furthermore, according to a method for fixing the shielding member to the door, the shielding member remains in the original attachment position and thus maintains its function without being damaged from its long-term use.

DETAILED DESCRIPTION

Embodiments of a display module and display device including the display module will now be described in detail with reference to accompanying drawings. As used herein, the singular forms "a", "an" and "the" are intended to include the plural forms as well, unless the context clearly indicates otherwise. For the sake of clarity, the elements of the drawings are drawn with exaggerated forms and sizes.

Figure 1:
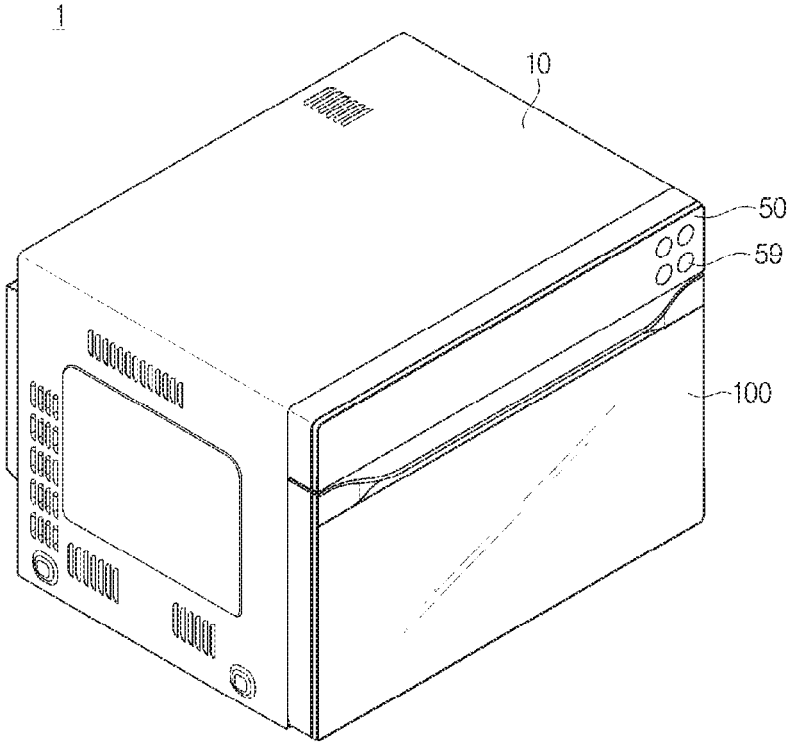
FIG. 1 is a perspective view of the appearance of a cooking appliance, according to an embodiment of the present disclosure.
Figure 2:
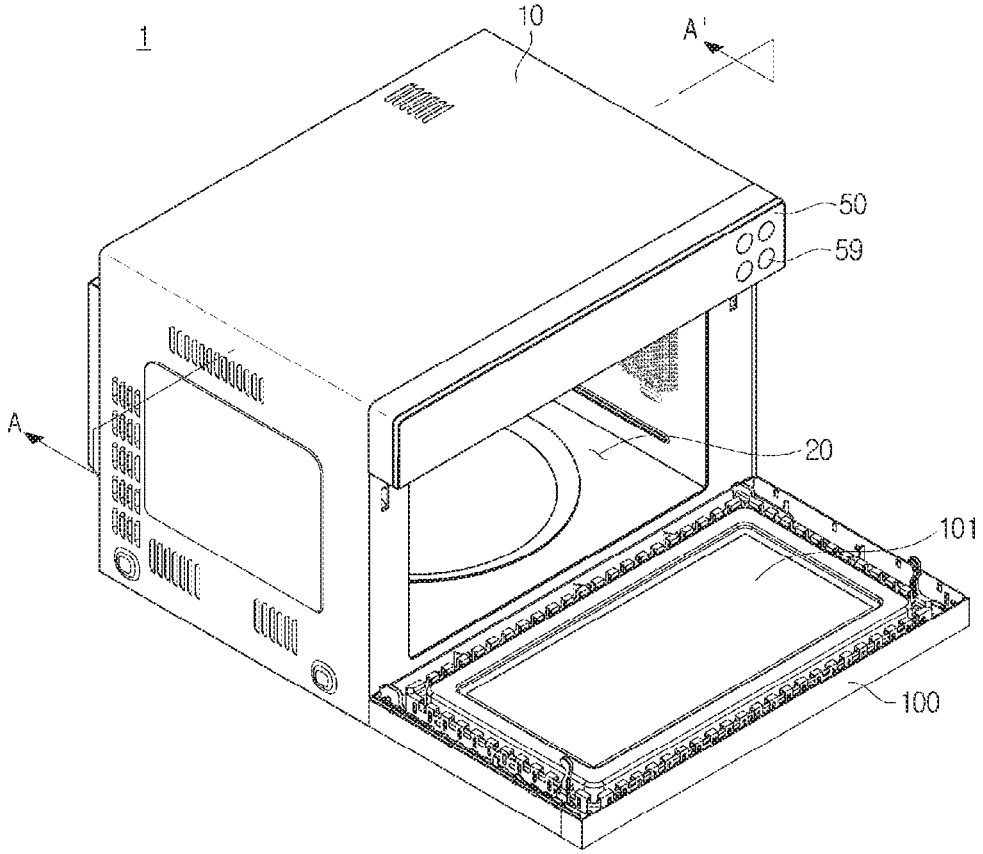
FIG. 2 is a perspective view of a cooking appliance with the door open, according to an embodiment of the present disclosure.

FIG. 1 is a perspective view of the appearance of a cooking appliance, according to an embodiment of the present disclosure, and FIG. 2 is a perspective view of a cooking appliance with the door open, according to an embodiment of the present disclosure.

As shown in FIGS. 1 to 2, a cooking appliance 1 includes a main body 10 forming the appearance and a cooking room 20 with space formed for cooking food inside the main body 10. In the following description, for convenience of explanation, a front direction is defined to be a direction in which a door 100 is installed with respect to the cooking appliance 1.

The cooking room 20 may be arranged on the inner side of the main body 10. The cooking room 20 may be formed at a predetermined distance inward from the main body 10.

An electric room 30 may be formed inside the main body 10. The electric room 30 may be equipped with electric components to operate the cooking appliance 1. The electric room 30 may be provided as a space formed above the cooking room 20 between the cooking room 20 and the main body 10. The cooking room 20 may be formed to have an open front. The open front of the cooking room 20 may be opened or closed by the door 100. The door 100 may be hinged on a side of the front face of the main body 10 to open or close the cooking room 20.

The door 100 may be equipped with a visible window 101 on the front to see into the cooking room 20 while the cooking room 20 is closed. The user may check a cooking process through the visible window 101 located in the door 100 while cooking.

The cooking room 20 may be formed with a plurality of plates combined together. In an embodiment, the cooking room 20 may include side plates forming the side of the cooking room 20, a top plate forming the top of the cooking room 20, and a bottom plate forming the bottom of the cooking room 20. The side plates, top plate, and bottom plate may be combined with each other by welding. Alternatively, the side plates, top plate, and bottom plate may be combined by screwing. The cooking room 20 may also be formed by bending a single plate.

A control panel 50 may be installed on the top front of the cooking appliance 1. The control panel 50 may be provided to operate the electric components equipped in the electric room 30.

The control panel 50 may include an input 59 and a display (not shown). The input 59 may be provided for the user a command for a function of the cooking appliance, such as a cooking function, a cooking mode, a cooking time, etc. In an embodiment, the input 59 may be equipped with a plurality of switches for the user to select a cooking mode. The input 59 may be provided with the plurality of switches in a touch sensing manner.

The display may be configured to display a condition set by the user and a corresponding operation state in letters, numbers, and symbols.

Figure 3:
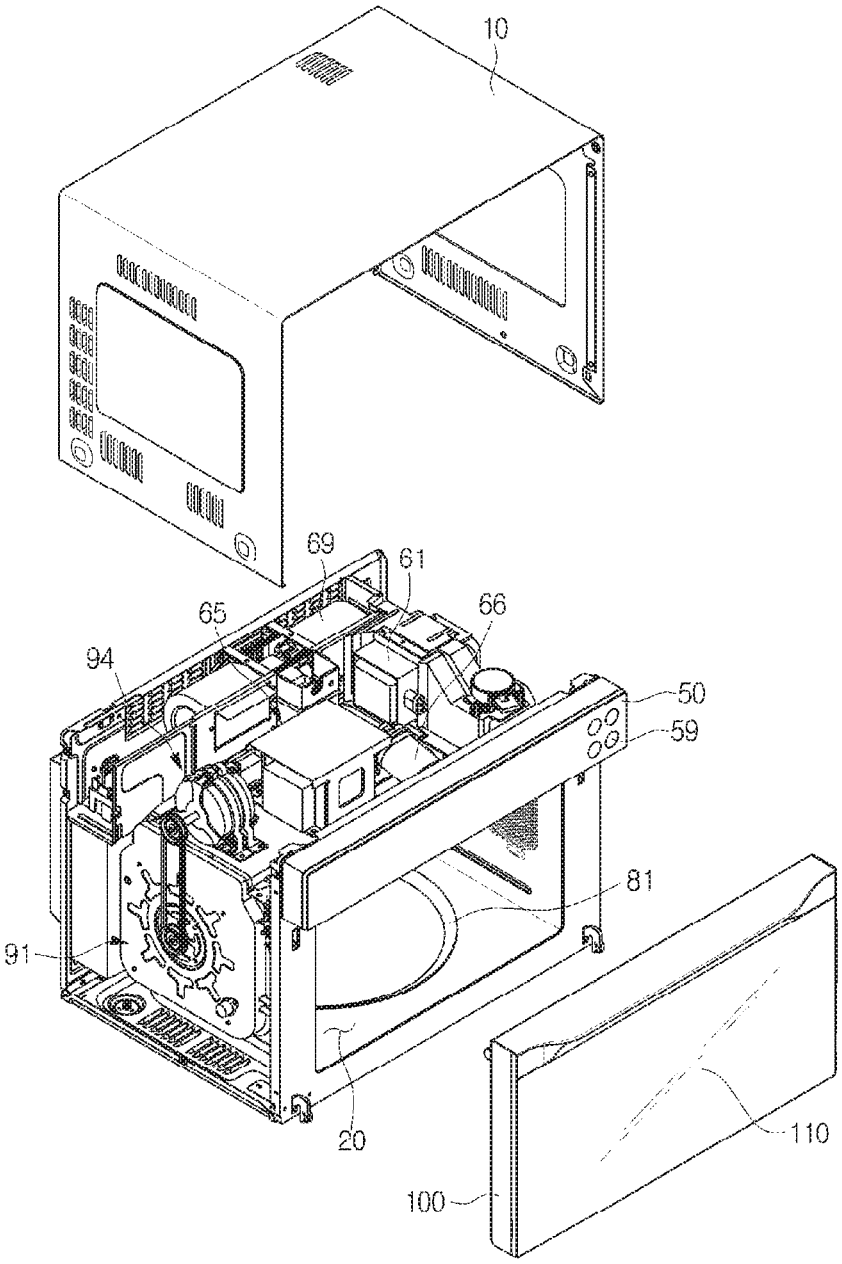
FIG. 3 is a perspective view of a cooking appliance where a main body and a door are separated, according to an embodiment of the present disclosure.
Figure 4:
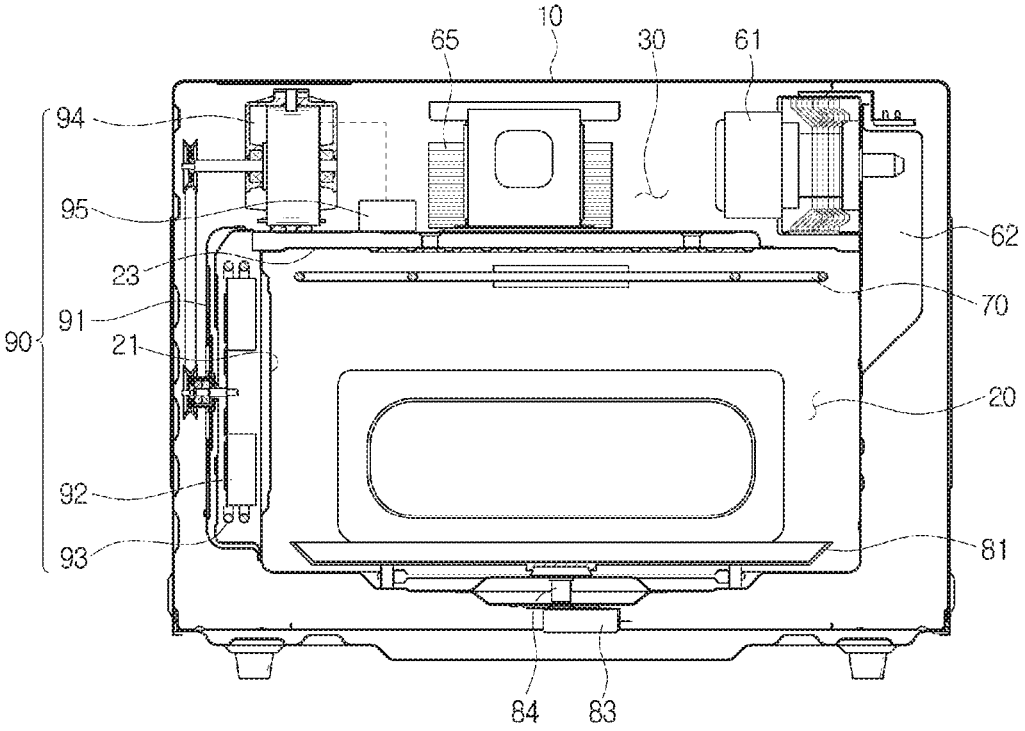
FIG. 4 is a cross-sectional view of a cooking appliance viewed from line A-A of FIG. 2.

FIG. 3 is a perspective view of a cooking appliance with a main body and a door separated, according to an embodiment of the present disclosure, and FIG. 4 is a cross-sectional view of the cooking appliance viewed from line A-A of FIG. 2.

Referring to FIGS. 3 and 4, the cooking appliance 1 may include a magnetron 61 to produce micro waves. The magnetron 61 is equipped in the electric room 30 and may produce micro waves radiated into the cooking room 20.

For example, the magnetron 61 may be installed on the outer side of the top plate 23 of the cooking room 20. The microwaves produced from the magnetron 61 may be irradiated into the cooking room 20 through a waveguide 62. The waveguide 62 may be connected to the magnetron 61 on one side and to one side of the cooking room 20 on the other side.

In the electric room 30, a high voltage transformer (HVT) 65, a high voltage condenser 66, a high voltage diode (not shown), a noise filter 69, and the like, which constitute a driving circuit to drive the magnetron 61 may be installed. The HVT 65, the high voltage condenser 66, the high voltage diode (not shown), and the noise filter 69 may be installed on the outer side of the top plate 23 of the cooking room 20. As such, the magnetron 61, the HVT 65, the high voltage condenser 66, the high voltage diode (not shown), and the noise filter 69 may all be located in the electric room 30 placed above the cooking room 20.

Although not shown, a cooling fan (not shown) may be arranged in the electric room 30 to blow air inside the electric room 30 to the outside of the cooking appliance 1. The cooling fan may move heat produced from an electric component, such as the magnetron 61, the HVT 65, the high voltage condenser 66, etc. placed in the electric room 30 to the outside of the cooking appliance 1.

In an embodiment, the electric components, such as the magnetron 61, the HVT 65, the high voltage condenser 66, the high voltage diode (not shown), and the noise filter 69 may be arranged in the electric room 30 placed above the cooking room 20. This may make the cooking appliance 1 increase the space to be occupied by the cooking room 20 in the inner space of the main body 10. As such, the cooking appliance 1 may have the internal space of the main body 10 efficiently used.

The cooking appliance 1 may further include a grill heater 70 to cook food by providing radiant heat. The grill heater 70 may be located inside the cooking room 20. The grill heater 70 may be installed to be located in the upper portion of the cooking room 20. The grill heater 70 may be arranged to face the top face of the cooking room 20. The grill heater 70 may produce radiant heat, which may be delivered to cook the food.

A tray 81 may be provided inside the cooking room 20 for food to be put thereon to be cooked. The tray 81 may be connected to a driving member 83 installed on the outer side of the cooking room 20 through a connector 84. The driving member 83 may produce driving force to turn the tray 81. The driving force produced from the driving member 83 may be delivered to the tray 81 through the connector 84 to turn the tray 81. Optionally, the driving member 83 may not be provided.

The cooking appliance 1 may further include a hot wind discharging unit 90 to cook providing by hot wind to food. The hot wind discharging unit 90 may produce air of high temperature to be provided into the cooking room 20. The hot wind discharging unit 90 may be configured to discharge hot air into the cooking room 20, which makes direct collision with food to transfer heat.

Referring to FIGS. 3 and 4, the hot wind discharging unit 90 may include a duct member 91 to guide the hot air to be moved to a particular direction from the outside of the cooking room 20. The duct member 91 may be linked to the cooking room 20.

Furthermore, hot wind discharging unit 90 may further include a heater 93 for heating air inside the duct member 91 to cook food, a blowing fan 92 for blowing the air heated by the heater 93, a motor 94 for providing driving force to the blowing fan 92, and a controller 95 for controlling the rotation speed of the motor 94.

Figure 5:
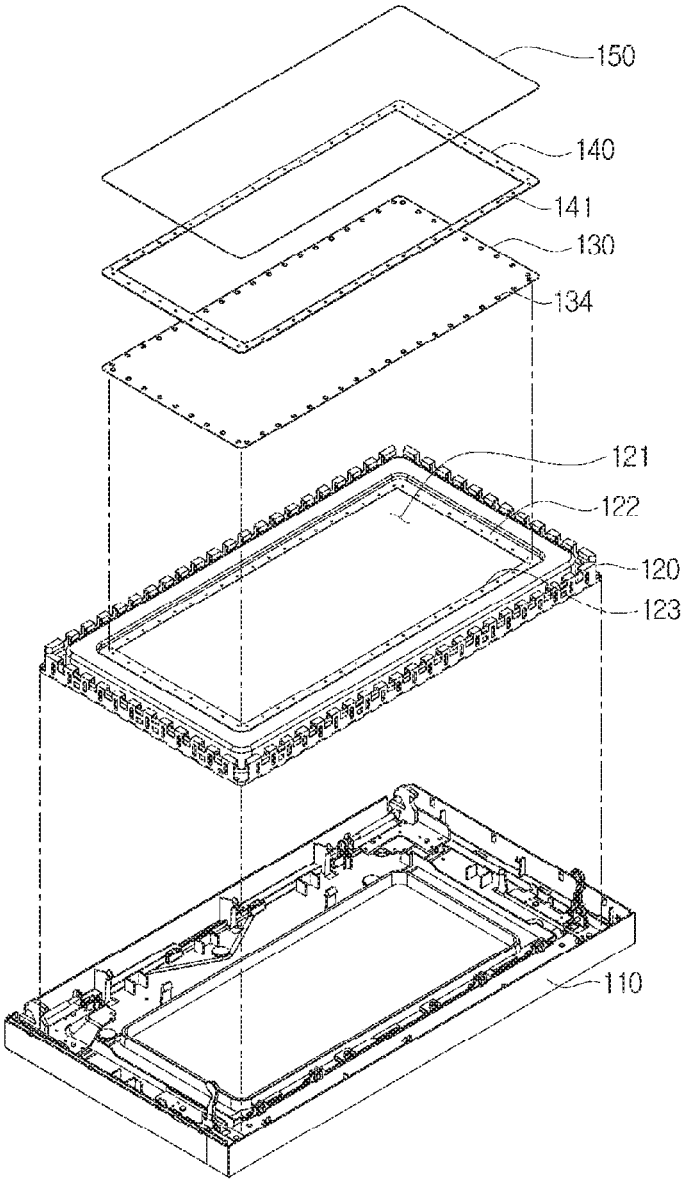
FIG. 5 is an exploded view of a door of a cooking appliance, according to an embodiment of the present disclosure.

FIG. 5 is an exploded view of a door of a cooking appliance, according to an embodiment of the present disclosure.

Referring to FIG. 5, the door 100 of the cooking appliance 1 includes a casing 110 forming the exterior and a door frame 120 arranged inside the casing 110. The casing 110 may be formed with the rear side open. It is common to manufacture the casing 110 by injecting polycarbonate. Although not shown, the rear side of the casing 110 may have a cover arranged not to expose the door frame 120. In the following description, for convenience of explanation, the rear side of the casing 110 may be defined to be the upper direction respect to the door frame 120.

The door frame 120 may include an opening 121 corresponding to the visible window 101 of the door 100 to see into the cooking room 20 when the door 100 is closed.

The cooking appliance 1 may include a magnetron to produce micro waves, and the magnetron may radiate electromagnetic waves called the micro waves into the cooking room 20 while the cooking appliance 1 is cooking. Accordingly, it is important to prevent the electromagnetic waves inside the cooking room 20 from leaking out through the visible window 101 of the door 100 during the cooking.

In the past, to prevent such a leakage of electromagnetic waves, a shielding panel equipped with multiple piercing holes having a constant pitch was used. With the conventional shielding panel, however, the door needs to be opened to check a cooking state in order to know of the detailed cooking process.

The door of the cooking appliance in accordance with the present disclosure has a structure to increase visibility of the inside of the cooking room by enabling electromagnetic waves to be shielded even if the multiple piercing holes are removed.

Referring to FIG. 5, a shielding member 130 configured to block electromagnetic waves may be arranged on the top of the door frame 120 to cover the opening 121 of the door frame 120.

The shielding member 130 may be formed with a conductive material to block electromagnetic waves applied onto a transparent plastic film such as PET or the panel so as to see into the cooking room 20 through the opening 121 of the door frame 120.

In an embodiment, a method for forming a blocking layer 133 in the shielding member 130 may have an imprinting method and a coating method. In the imprinting method, a resin is applied onto a substrate, and a mold that may form tiny grooves is applied on top of the resin, forming the tiny grooves through irradiation of ultraviolet (UV) rays. The blocking layer 133 having conductivity may be formed in the shielding member 130 by squeezing silver (AG) paste in the tiny grooves formed on the substrate and repeating hardening by heat.

In the coating method, a primer for increasing adhesive force is applied first to apply a silver (Ag) line on a film such as PET, the silver line is applied on top of the primer, and then a plating layer and a conductive layer are applied.

Furthermore, the shielding member 130 may form a conductive blocking layer on a transparent glass material or panel in the imprinting method or in the coating method.

The shielding member 130 may be arranged for the blocking layer 133 formed with a material to block electromagnetic waves applied thereon to face the door frame 120, and the door frame 120 may be formed for a border portion 122 around the opening 121, which meets the blocking layer 133 of the shielding member 130, to have conductivity.

The border portion 122 of the opening 121 of the door frame 120 may be formed by applying a conductive material onto the border portion 122 to have conductivity, or the door frame 120 itself may be formed with a conductive material. In the case of forming the door frame 120 itself with a conductive material, the border portion 122 of the opening 121 of the cooking appliance 1 should not be painted in order to expose the conductive material. In an embodiment, the door frame 120 may be manufactured by bending a cold rolled galvanized steel sheet for processing.

As the blocking layer 133 of the shielding member 130 and the border portion 122 of the door frame 120 are in contact and electrically connected, the electromagnetic waves produced inside the cooking room may not pass the shielding member 130 but make a detour to the door frame 120 by the blocking layer 133 of the shielding member 130.

Since the blocking layer 133 formed in the shielding member 130 has the conductive material applied at intervals far smaller than the wavelength of the electromagnetic wave, the electromagnetic wave may not pass the blocking layer 133 but flow to the border portion 122 of the door frame 120 electrically connected to the shielding member 130 in the form of a displacement current. The current flowing to the door frame 120 enables the electromagnetic waves to be shielded by a choke structure of the door frame 120, and the choke structure of the door frame 120 is configured to have a bending portion 127 extending from the border portion 122 formed as a cavity as long as ¼ wavelength of the electromagnetic produced inside the cooking room 120. The cooking appliance using electromagnetic waves needs to meet an international standard of shielding of electromagnetic waves, the UL 923 standard. According to the UL 923 standard, the shielding member 130 of the cooking appliance in accordance with the present disclosure may be configured such that when electromagnetic waves are measured 5 cm away from the outer face, the plane-wave power density should not exceed 5 mW per square centimeter.

In order for the blocking layer 133 of the shielding member 130 to surely make an electrical contact with the border portion 122 of the opening 121 of the door frame 120 and to fix the attachment position of the shielding member 130 to remain the same, a fixing member 140 may be arranged in the door 100 on top of the shielding member 130 to be combined with the door frame 120 with the shielding member 130 located in between. The fixing member 140 may be manufactured from a melted galvanized steel sheet (GI) in a pressing method. Furthermore, the fixing member 140 may be formed in the figure corresponding to the border portion 122 of the opening 121 of the door frame 120, and may include coupling portions 141 to be coupled with coupled portions 123 of the door frame 120.

Referring to FIG. 5, the door 100 may include at least one screen 150 to protect the shielding member 130 against external shock, such as spattering of food inside the cooking room 20. The screen 150 may be manufactured from a glass material.

A first screen 151 may be arranged on top of the fixing member 140 that fixes the shielding member 130 to cover the coupling portions 141 of the fixing member 140, thereby protecting the shielding member 130 and even protecting the coupling between the fixing member 140 and the door frame 120. In addition, as will be described later, the coupling portion 141 of the fixing member 140 may be formed as a burring portion 142 to be able to prevent foreign material from getting into the casing 110 through a burring hole 143 of the burring portion 142 when the screen 150 is arranged to cover the coupling portion 141 of the fixing member 140.

Although not shown in FIG. 5, a second screen 152 may be arranged under the door frame 120 to prevent the shielding member 130 from being damaged by the foreign material getting into the casing 110.

Figure 7A:
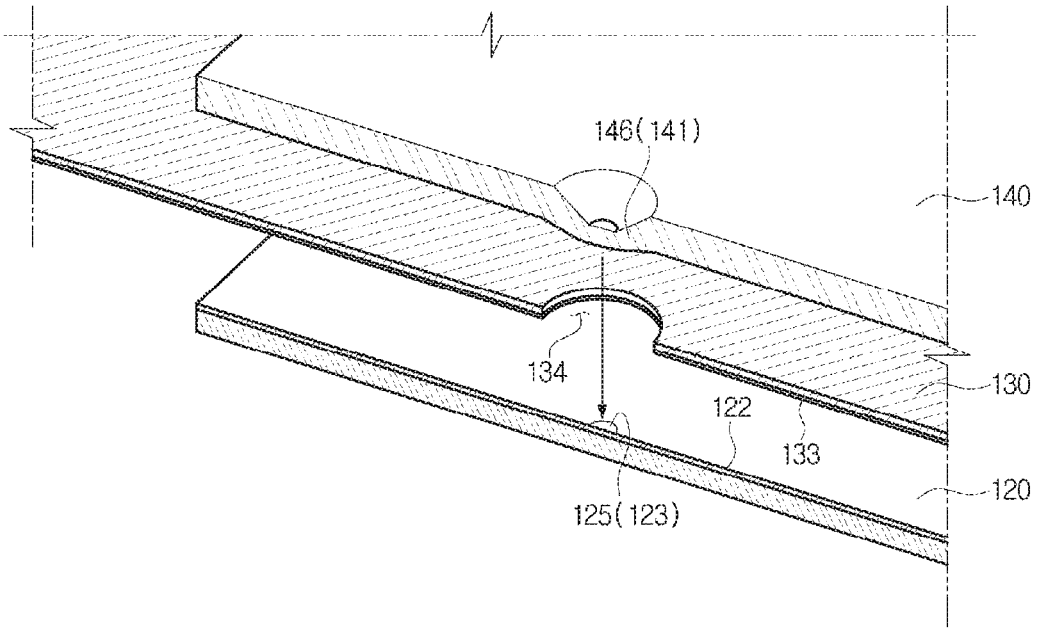
FIGS. 7A and 7B show a modification of the coupling between the fixing member and the door frame of FIGS. 6A and 6B.
Figure 7B:
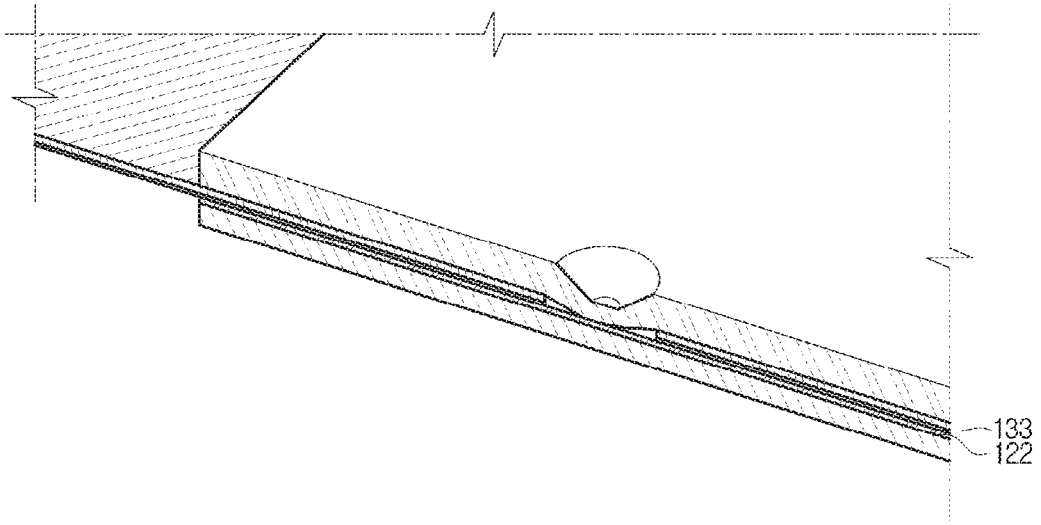
Figure 8A:
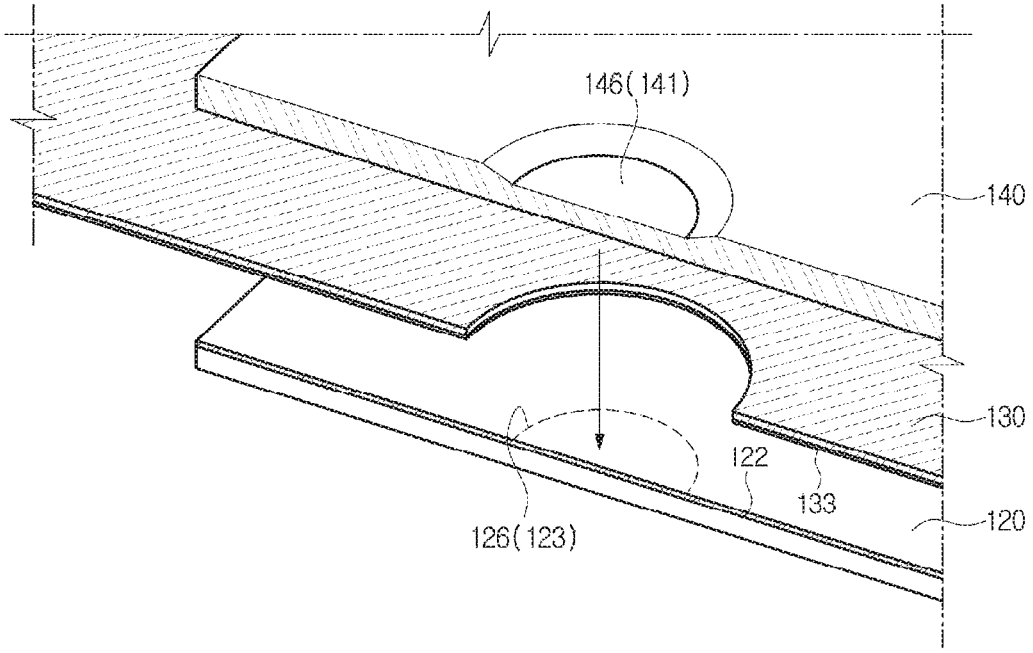
FIGS. 8A and 8B show another modification of the coupling of the fixing member and the door frame of FIGS. 6A and 6B.
Figure 8B:
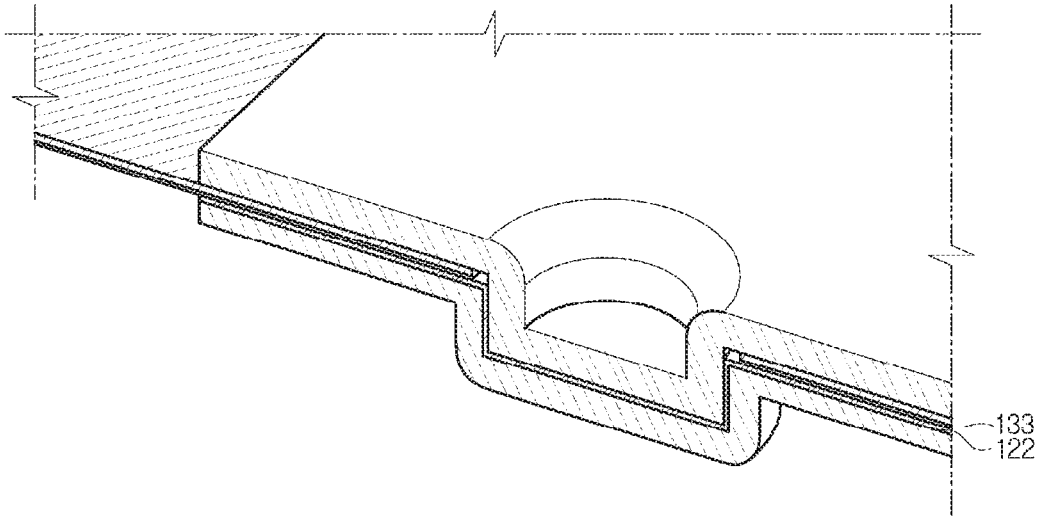
Figure 9:
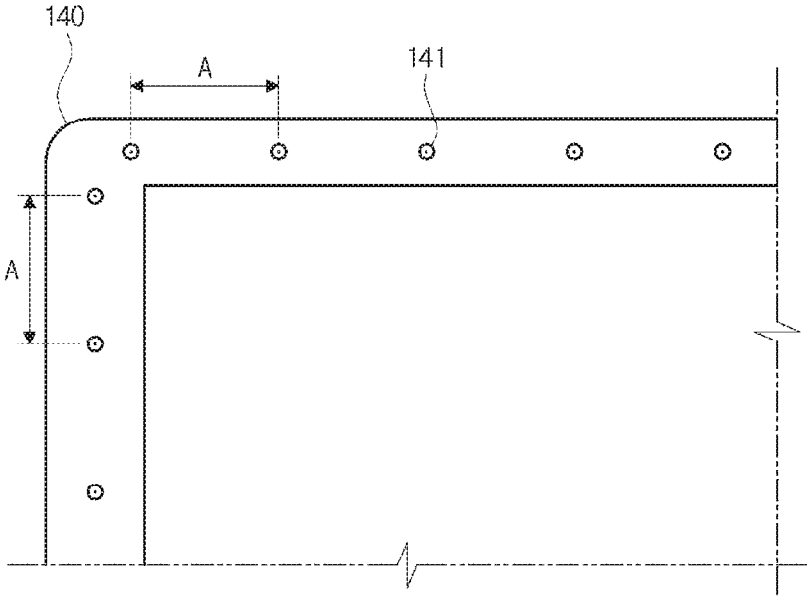
FIG. 9 shows intervals of coupling portions of the fixing member of FIGS. 6A to 8B.

FIGS. 6A to 8B are cross-sectional views of coupling portions between a fixing member and a door frame, according to an embodiment of the present disclosure, and FIG. 9 shows an interval of the coupling portions of the fixing member of FIGS. 6A to 8B.

Figure 6A:
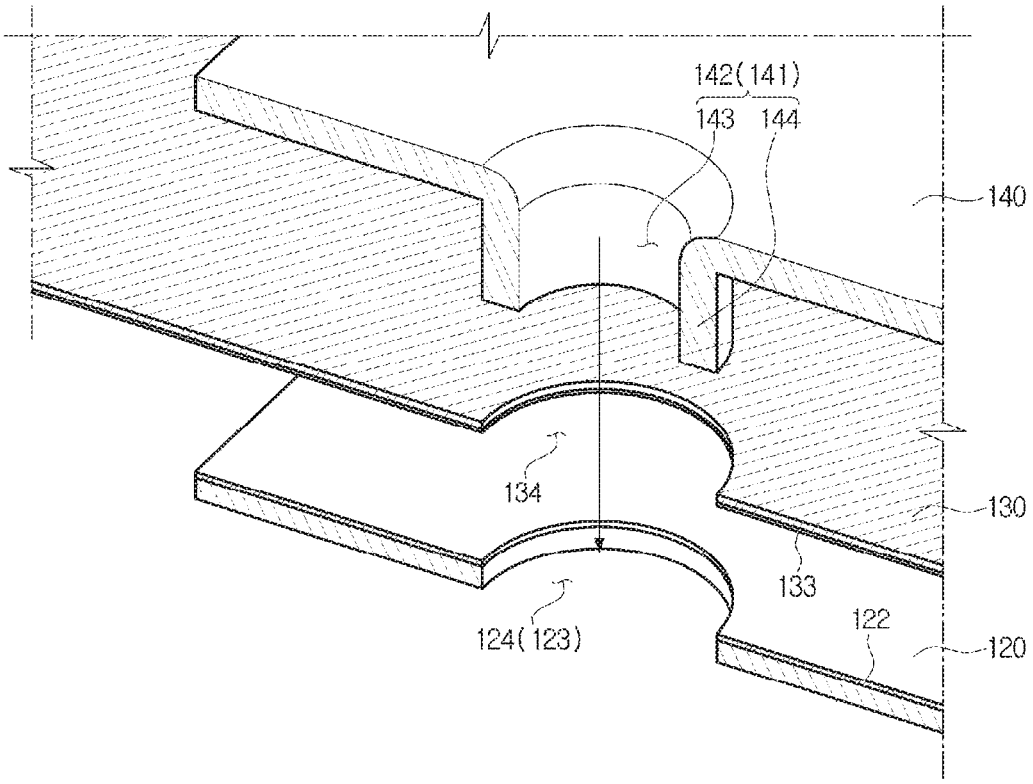
FIGS. 6A and 6B show coupling between a fixing member and a door frame, according to an embodiment of the present disclosure.
Figure 6B:
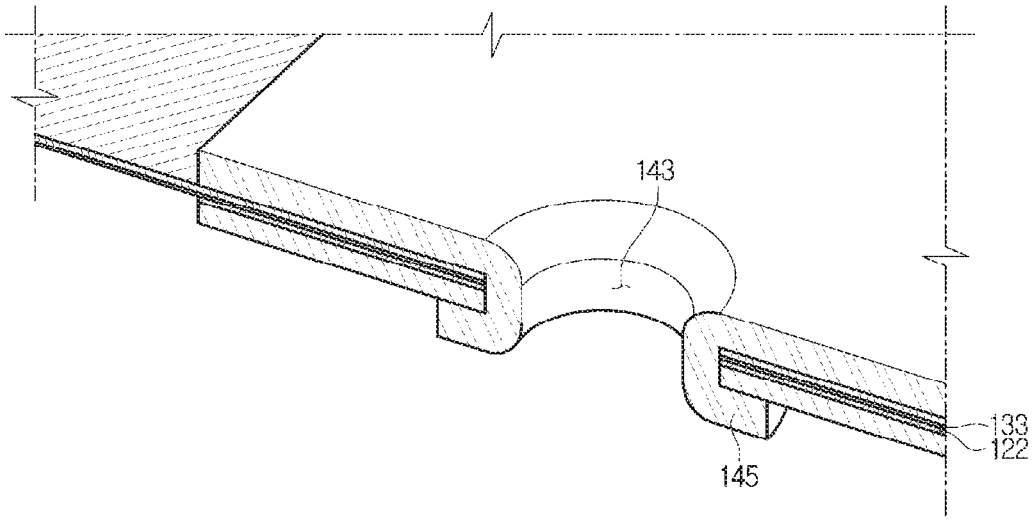

Referring to FIGS. 6A and 6B, an example is shown, in which the coupling portion 141 of the fixing member 140 are the burring portion 142 including a burring hole 143 and a side wall 144 surrounding the burring hole 143. The side wall 144 of the burring hole 143 may extend to the shielding member perpendicularly the fixing member 140. A through hole 134, through which the side wall 144 of the burring hole 143 may pass, may be formed in the shielding member 130, and another through hole 124, through which the side wall 144 of the burring hole 143 of the fixing member 140 may pass, may be formed even in the coupled portion 123 of the door frame 120 to be coupled with the coupling portion 141 of the fixing member 140.

The side wall 144 of the burring hole 143 of the fixing member 140 that protrudes after passing through the through hole 134 of the shielding member 130 and the through hole 124 of the door frame may be bent outward in the radial direction of the burring hole 143 to form a curling portion 145, allowing the fixing member 140, the shielding member 130, and the door frame 120 to be combined together.

Referring to FIGS. 7A and 7B, an example of coupling between the coupling portion 141 of the fixing member 140 and the coupled portion 123 of the door frame 120 by welding is illustrated. The coupling portion 141 of the fixing member 140 may include a welding projection 146 protruding toward the shielding member perpendicularly to the fixing member 140, enabling the welding position to be checked and enabling coupling with the coupled portion 123 of the door frame 120. The shielding member 130 may have the through hole 134 formed for the welding projection of the fixing member 140 to pass through, and the coupled portion 123 of the door frame 120 may include a conductive welded portion 125 at which the welding projection 146 of the fixing member 140 may be welded.

As the welding projection 146 of the fixing member 140 passes through the through hole 134 of the shielding member 130 and is welded at the welded portion 125 of the door frame, the fixing member 140, the shielding member 130, the door frame 120 may be combined together.

Referring to FIGS. 8A and 8B, an example of coupling between the coupling portions 141 of the fixing member 140 and the coupled portions 123 of the door frame 120 by pressing is illustrated. Specifically, the coupling portion 141 of the fixing member 140 may include a pressing portion 147 pressed to the shielding member 130 at the right angle to the fixing member 140, and the coupled portion 123 of the door frame 120 may include a pressed portion 126 to be pressed and combined with the pressing portion 147 of the fixing member 140. The through hole 134, through which the pressing portion 147 of the fixing member 140 may pass, may be formed in the shielding member 130, and the pressing portion 147 of the fixing member 140 may be pressed to pass through the through hole 134 of the shielding member 130 and be combined with the pressed portion 126 of the door frame 120, thereby enabling the fixing member 140, the shielding member 130, and the door frame 120 to be combined together.

Referring to FIG. 9, the coupling portion 141 of the fixing member, i.e., the burring portion 142, the welding projection 146, the pressing portion 147 may be arranged along the border portion 122 of the door frame 120 where the shielding member 130 and the door frame 120 joins. The interval A at which the coupling portions 141 are arranged suggests a minimum interval threshold at which the shielding member 130 and the door frame 120 are to be electrically connected. In other words, to ensure the minimum interval, 50 mm, for the shielding member 130 and the door frame 120 to be electrically connected to prevent electromagnetic waves produced inside the cooking room 20 from leaking out, the coupling portions 141 of the fixing member 140 may be arranged at the intervals A of 50 mm or less. Preferably, the coupling portions 141 may be arranged at the intervals A of 30 mm or less. More preferably, the coupling portions 141 may be arranged at the intervals A of 20 mm or less.

Figure 10:
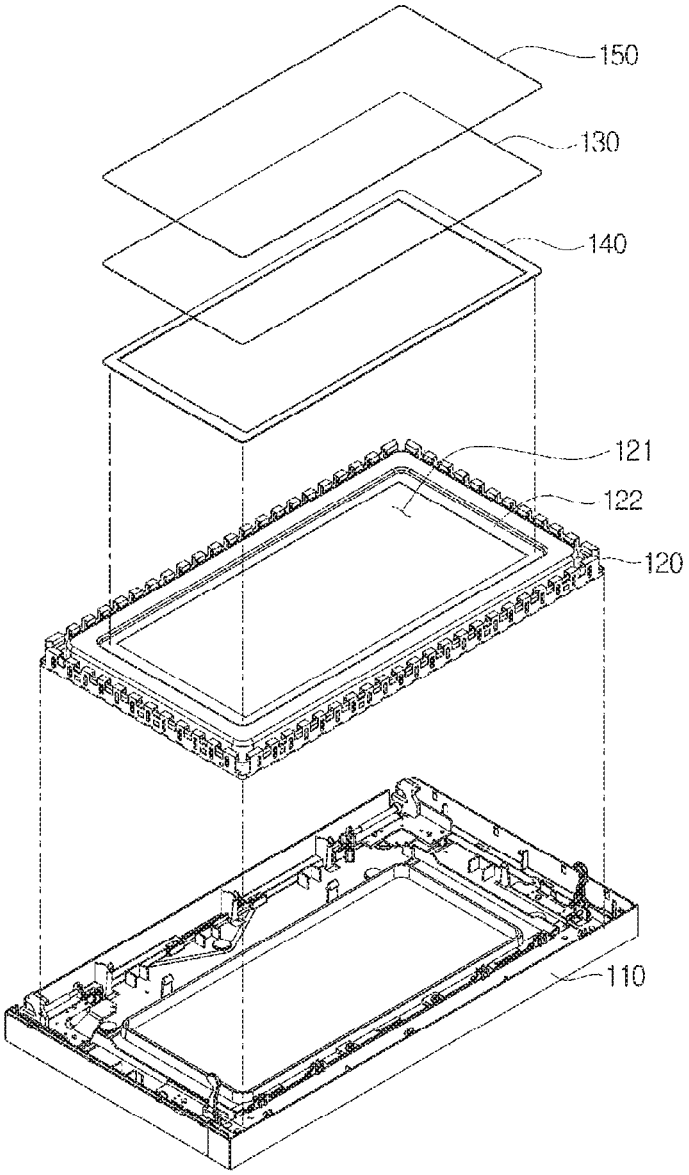
FIG. 10 is an exploded view of a door of a cooking appliance, according to another embodiment of the present disclosure.
Figure 11A:
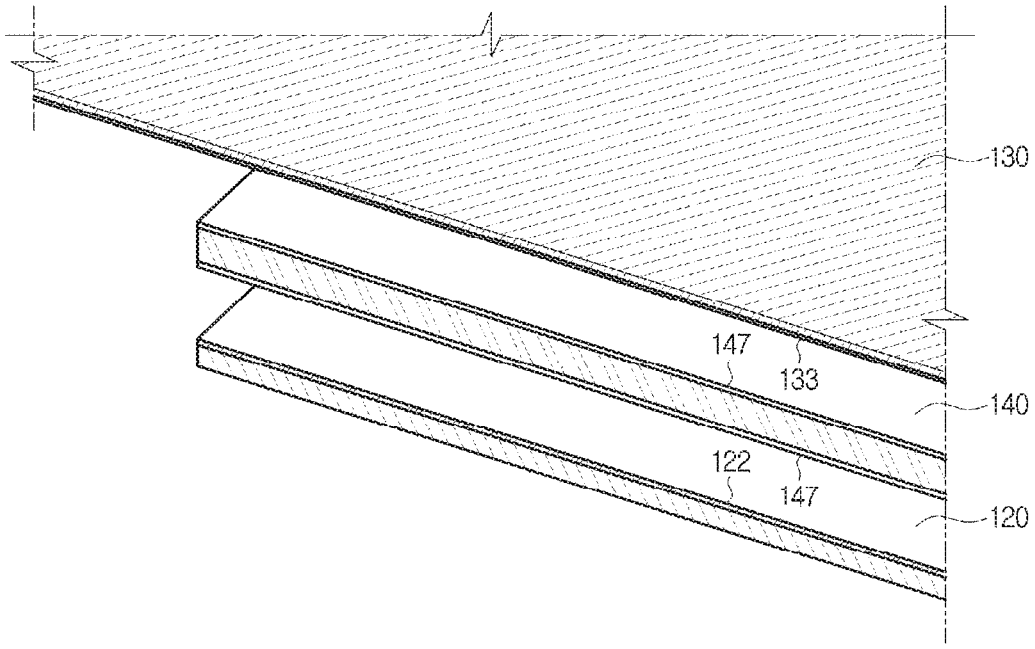
FIGS. 11A and 11B show coupling between a shielding member, a fixing member and a door frame, according to another embodiment of the present disclosure.
Figure 11B:
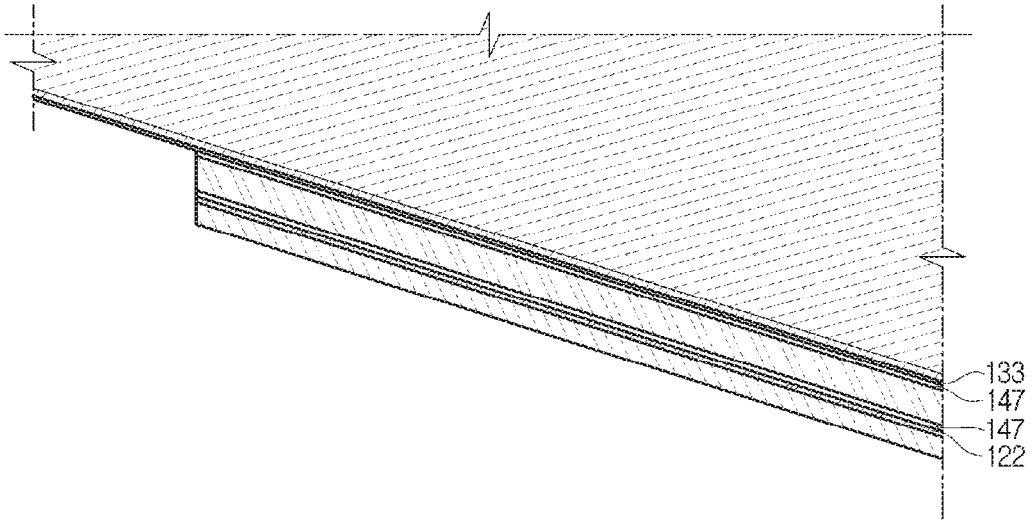

FIG. 10 is an exploded view of a door of a cooking appliance, according to another embodiment of the present disclosure, and FIGS. 11A and 11B show coupling between a shielding member, a fixing member and a door frame, according to another embodiment of the present disclosure.

Coupling between the door 100 of the cooking appliance 1, the shielding member 130, the fixing member 140, and the door frame 120 as shown in FIGS. 10, 11A and 11B, significantly differs in structure from coupling between the door 100 of the cooking appliance 1, the shielding member 130, the fixing member 140, and the door frame 120 and arrangement of the fixing member 140 as shown in FIGS. 3 to 6B. Accordingly, description about the same configurations as the embodiment shown in FIGS. 3 to 6B will be omitted below.

Referring to FIGS. 10, 11A and 11B, the shielding member 130 configured to block electromagnetic waves may be arranged on top of the door frame 120 to cover the opening 121 of the door frame 120 with the fixing member 140 to combine the shielding member 130 and the door frame 120 arranged between the shielding member 130 and the door frame 120.

The fixing member 140 may include adhesive layers 148 on the shielding member 130 and on the door frame 120, and may be formed of a conductive material. The fixing member 140 may be arranged on the border portion f the opening 121 of the door frame 120 to combine the shielding member 130 and the door frame 120 while connecting the shielding member 130 and the door frame 120 electrically.

FIGS. 12 to 16 are exploded views of a main body of a cooking appliance and a door of the cooking appliance, according to other embodiments of the present disclosure. FIGS. 12 to 16 show differences in order of arranging the respective components in the door 100 of the cooking appliance 1 between the respective configurations. As in FIGS. 1 and 2, for convenience of explanation, a front direction is defined to be a direction in which the door 100 is installed with respect to the cooking appliance 1.

Basically, the cooking appliance 1 in accordance with another embodiment may include the main body 10 having the cooking room 20 and the door 100 arranged on the front of the main body 10 to open and close the cooking room 20 and having the visible window 101 to see into the cooking room 20.

The door 100 of the cooking appliance 1 may include the casing 110 forming the appearance, the door frame 120 arranged in the casing 110 and having the opening 121 corresponding to the visible window 101 of the door 100, at least one shielding member 130 configured to prevent electromagnetic waves from leaking out through the opening 121 and the visible window 101, at least one fixing member formed in the figure corresponding to the border portion 122 of the opening 121 of the door frame 120 and having coupling portion 141 to be coupled with the door frame 120, and at least one screen 150 to be able to protect the shielding member 130 against an external shock.

The shielding member 130 may include the blocking layer 133 formed with a conductive material that blocks electromagnetic waves applied thereon, and may be arranged such that the blocking layer 133 is directed to the door frame 120 to cover the opening 121 of the door frame 120.

Although the fixing member 140 to be combined with the door frame 120 with the shielding member 130 located in between in FIGS. 12 to 16, the fixing member 140 may fix the shielding member 130 and the door frame 120 between the shielding member 130 and the door frame 120.

The border portion 122 of the opening 121 of the door frame 120 may be formed to have conductivity, and the blocking layer 133 of the shielding member 130 may join the border portion 122 of the opening 121 of the door frame 120 to be electrically connected thereto.

Figure 12:
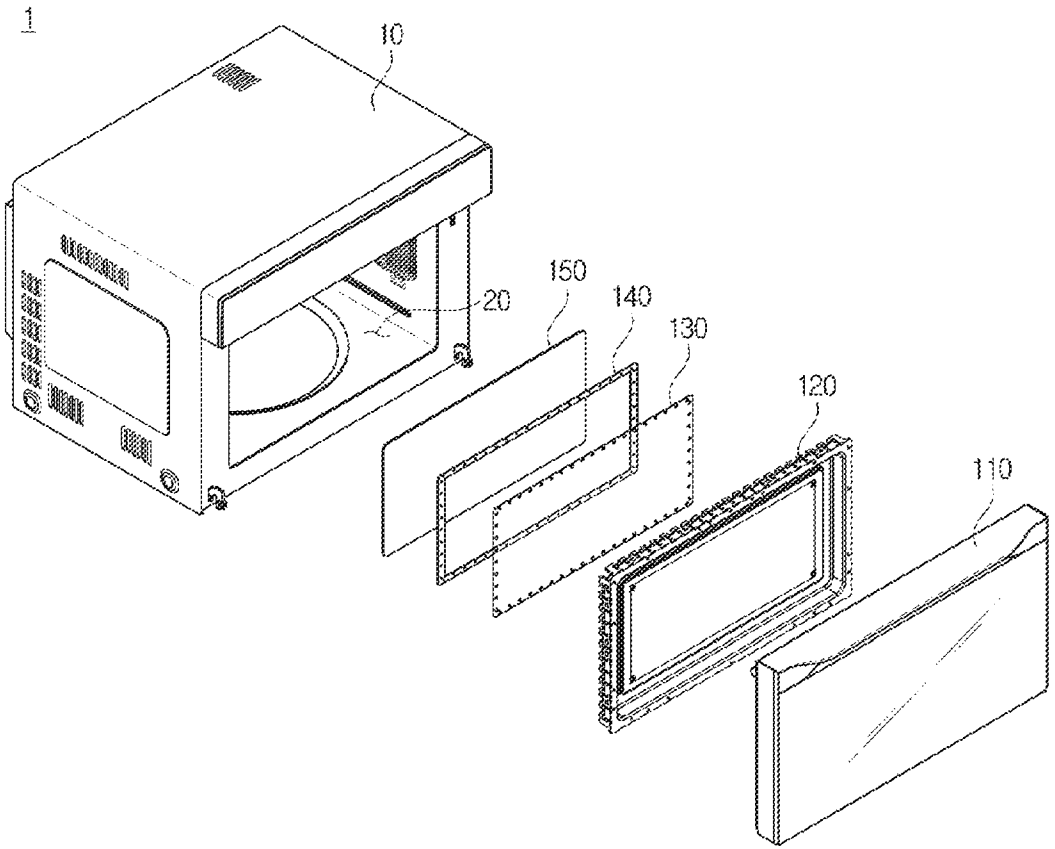
FIG. 12 is an exploded view of a main body of a cooking appliance and a door of the cooking appliance, according to another embodiment of the present disclosure.

Referring to FIG. 12, the shielding member 130 may be arranged between the cooking room 20 and the door frame 120, and the screen 150 may be arranged to cover the coupling portion 141 of the fixing member 140 in between the shielding member 130 and the cooking room 20.

Figure 13:
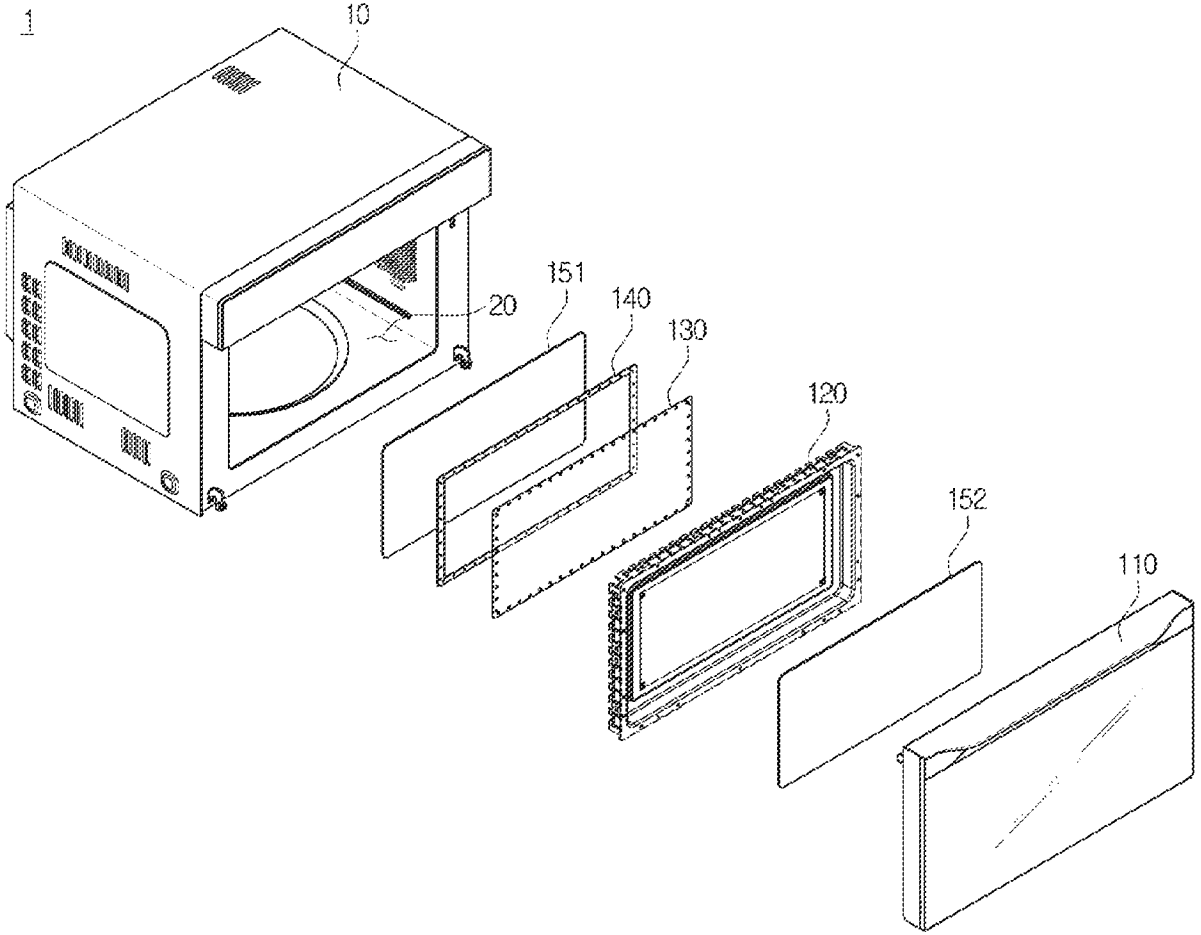
FIG. 13 is a modification of the door of FIG. 12.

Referring to FIG. 13, the shielding member 130 may be arranged between the cooking room 20 and the door frame 120, and the screen 150 may each be arranged between the shielding member 130 and the cooking room 20 and between the door frame 120 and the casing 110.

Figure 14:
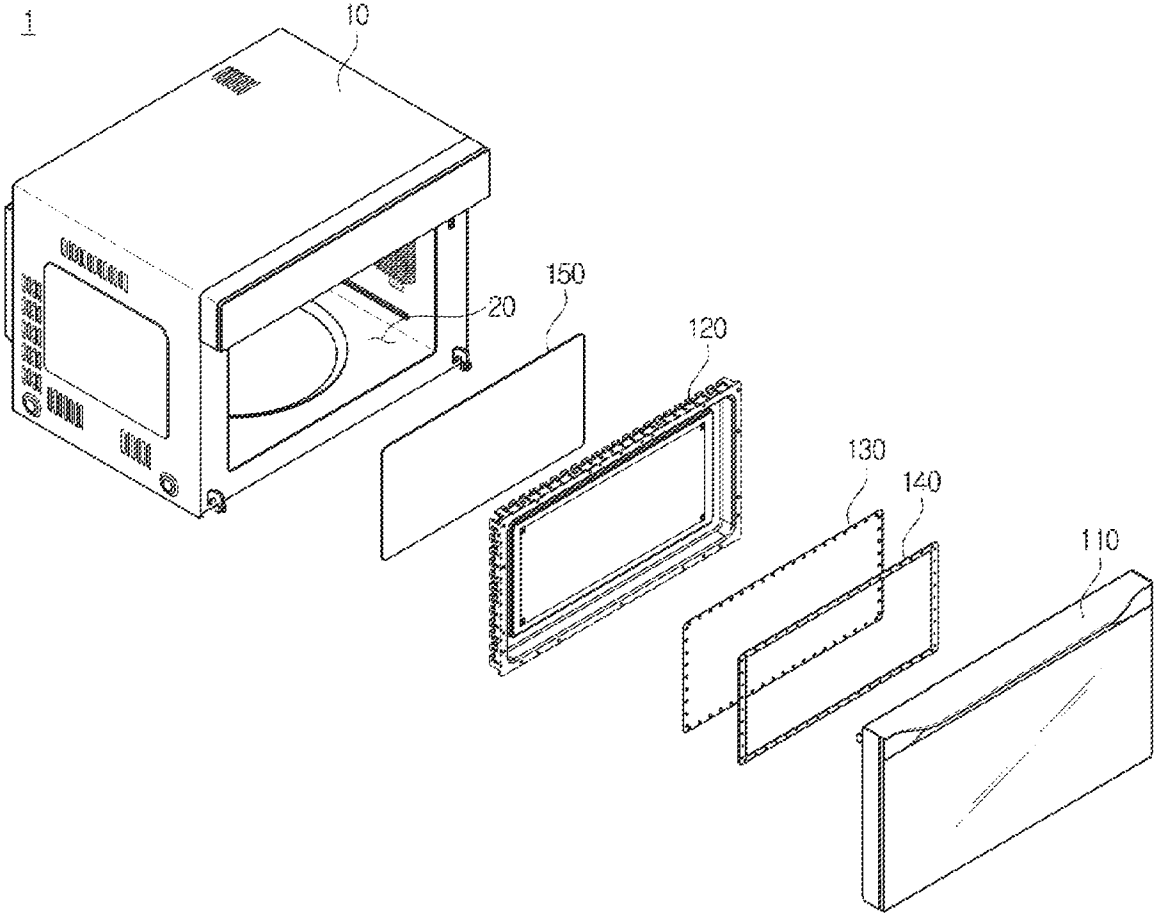
FIG. 14 is another modification of the door of FIG. 12.

Referring to FIG. 14, the shielding member 130 may be arranged between the door frame 120 and the casing 110, and the screen 150 may be arranged between the cooking room 20 and the door frame 120.

Figure 15:
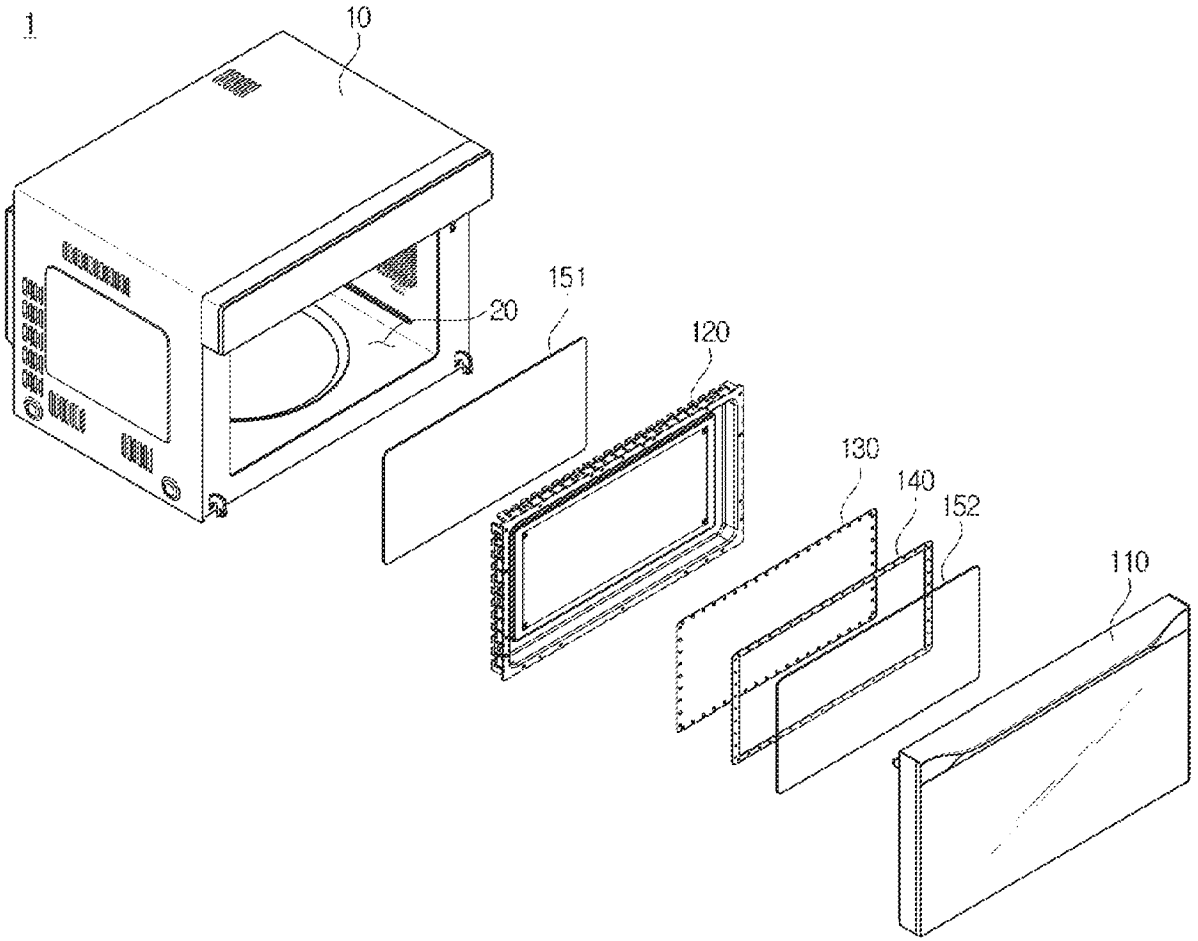
FIG. 15 is another modification of the door of FIG. 12.

Referring to FIG. 15, the shielding member 130 may be arranged between the door frame 120 and the casing 110, and the screen 150 may each be arranged between the cooking room 20 and the door frame 110 and between the shielding member 130 and the casing 110.

Figure 16:
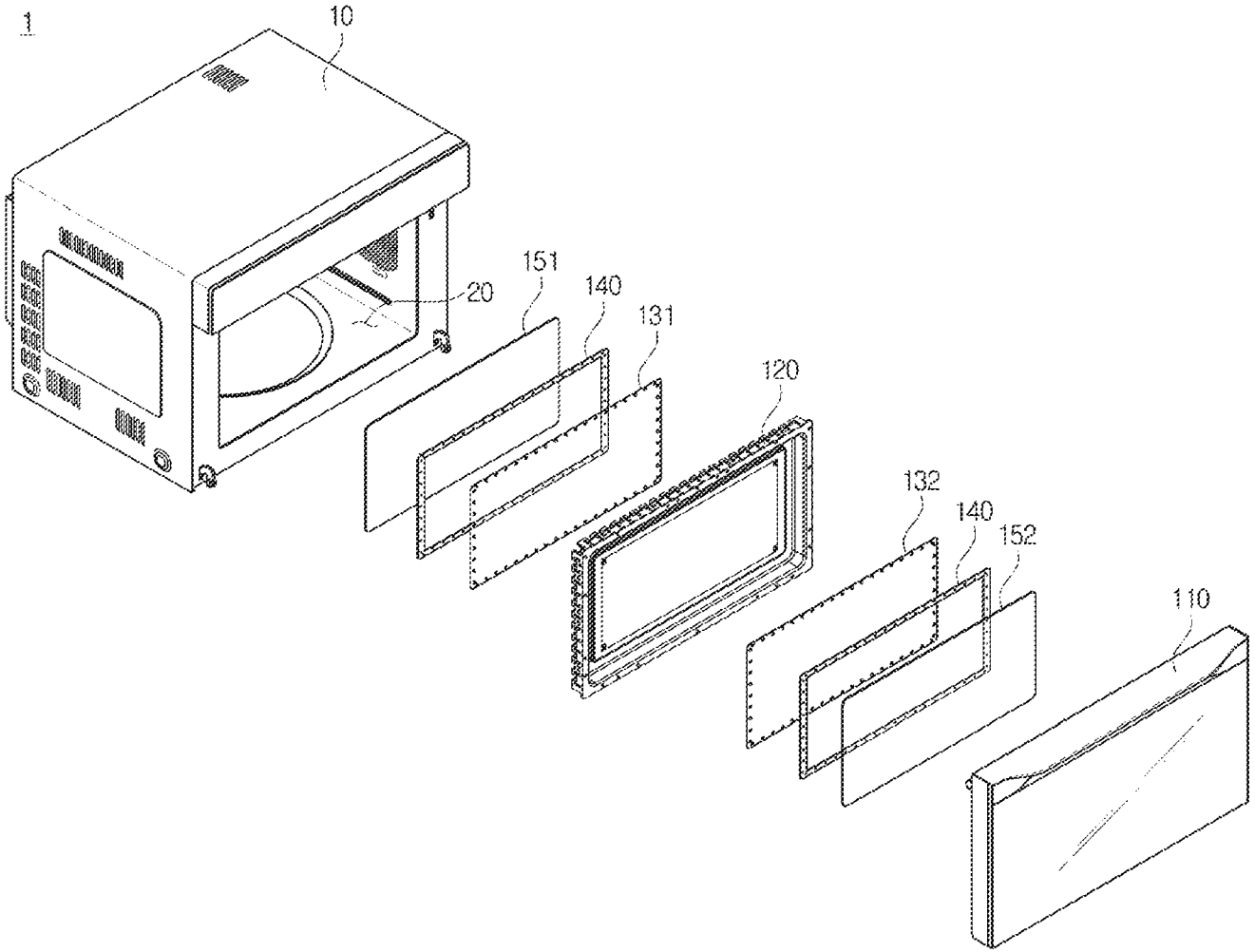
FIG. 16 is another modification of the door of FIG. 12.

Referring to FIG. 16, a first shielding member 131 may be arranged between the cooking room 20 and the door frame 120, and a second shielding member 132 may be arranged between the door frame 120 and the casing 110. Furthermore, a first screen 151 may be arranged between the cooking room 20 and the first shielding member 131, and a second screen 152 may be arranged between the second shielding member 132 and the casing 110.

A method for fixing the shielding member 130 for blocking electromagnetic waves onto the door 100 of the cooking appliance 1 having the visible window 101 to see into the cooking room 20 will now be described with reference to FIGS. 5 to 9.

First, the shielding member 130 including the blocking layer 133 for blocking electromagnetic waves is prepared, in which case the blocking layer 133 is formed by applying a conductive material to block electromagnetic waves on a transparent plastic film or panel or by applying a conductive material to block electromagnetic waves on a transparent glass film or panel. The shielding member 130 including the blocking layer 133 may have transparent or translucent visibility, and it is desirable to secure visibility of 70% or more.

The door frame 120 including the opening 121 corresponding to the visible window 101 of the door 100 to see into the cooking room 20 through the visible window 101 and the border portion 122 of the opening 121 to be in contact with the blocking layer 133 of the shielding member 130 formed to have conductivity is prepared.

A conductive material may be applied on the border portion 122 of the opening 121 of the door frame 120 to give conductivity to the border portion 122 of the opening 121, or the door frame 120 itself may be formed with a conductive material to make the border portion 122 of the opening 121 have conductivity in a way of excluding the border portion 122 of the opening 121 in a painting process of the door frame 120.

The shielding member 130 is arranged such that the conductive blocking layer 133 faces the door frame 120 and the blocking layer 133 comes in contact with the border portion 122 of the opening 121 of the door frame 120.

To fix the shielding member 130 to the door frame 120 and secure electrical connection between the blocking layer 133 of the shielding member 130 and the border portion 122 of the opening 121 of the door frame 120, the fixing member 140 is bonded to the door frame 120 with the shielding member 130 interposed between the fixing member 140 and the door frame 120.

To fix the shielding member 130 to the door frame by bonding the fixing member 140 and the door frame 120, the coupling portion 141 to be coupled with the door frame 120 may be arranged in the fixing member 140; the through hole 134, through which the coupling portion 141 of the fixing member 140 passes, may be arranged in the shielding member 130; the coupled portion 123 to be coupled with the coupling portion 141 of the fixing member 140 may be arranged in the door frame 120. As the coupling portion 141 of the fixing member 140 is bonded to the coupled portion 123 of the door frame 120 by penetrating the through hole 134, the shielding member 130 may be fixed to the door frame 120.

In a method in accordance with an embodiment, the coupling portion 141 of the fixing member 140 may be provided as the burring portion 142 formed by burring. The burring portion 142 may be provided to include the burring hole 143 and the side wall 144 surrounding the burring hole 143. The side wall 144 of the burring hole 143 may be formed to extend to the shielding member 130. The through hole 124 for the burring portion to pass through may be formed in the coupled portion 123 of the door frame 120, and the shielding member 130 may be fixed to the door frame 120 by pressing and bending the side wall 144 of the burring hole 143 of the burring portion 142 protruding after passing through the through hole 134 of the shielding member 130 and the through hole 124 of the door frame 120 outward in the radial direction of the burring hole 143.

In a method in accordance with another embodiment, the coupling portion 141 of the fixing member 140 and the coupled portion 123 of the door frame 120 may be bonded by welding. A welding projection configured to check the welding position for welding may be arranged in the coupling portion 141 of the fixing member 140. The welding projection 146 may be formed to protrude toward the shielding member 130 at the right angle to the fixing member 140. The coupled portion 123 of the door frame 120 may be provided as the conductive welded portion 125 allowing for welding, and the shielding member 130 may be fixed to the door frame 120 by penetrating the welding projection 146 of the fixing member 140 through the through hole 134 of the shielding member 130 and welding it to the welded portion 125 of the door frame 120.

In a method in accordance with another embodiment, the coupling portion 141 of the fixing member 140 and the coupled portion 123 of the door frame 120 may be bonded by pressing. The shielding member 130 may be fixed to the door frame 120 by pressing the coupling portion 141 of the fixing member 140 together with the coupled portion 123 of the door frame 120 to pass through the through hole 134 of the shielding member 130.

In the aforementioned methods for coupling the shielding member 130 to the door frame 120, the coupling portions 141 of the fixing member 140 may be provided along the border portion 122 of the opening 121 where the shielding member 130 and the door frame 120 contact at intervals of 5 mm or less and then combined with the coupled portions 123. The coupling portions 141 may be formed in the fixing member 140 at intervals of preferably, 30 mm or less and more preferably, 20 mm or less more preferably.

A method for fixing the shielding member 130 for blocking electromagnetic waves onto the door 100 of the cooking appliance 1 having the visible window 101 to see into the cooking room 20 in accordance with another embodiment will now be described with reference to FIGS. 10, 11A, and 11B.

A procedure of preparing the shielding member 130 and the door frame 120 is the same as what is described with reference to FIGS. 3 to 7.

Moreover, as in the fixing method described with reference to FIGS. 5 to 9, the shielding member 130 may be arranged such that the conductive blocking layer 133 faces the door frame 120 and the blocking layer 133 comes into contact with the border portion 122 of the opening 121 of the door frame 120.

Referring to FIGS. 10, 11A and 11B, in a method in accordance with another embodiment, the adhesive layer 148 may be included for the shielding member 130 to be fixed to the door frame 120, and the conductive fixing member 140 may be arranged between the shielding member 130 and the door frame 120.

The shielding member 130 and the door frame 120 may be electrically connected and the shielding member 130 may be fixed to the door frame 120 by arranging the conductive fixing member 140 including the adhesive layers 148 on the door frame 120 and on the shielding member 130 along the border portion 122 of the opening 121 where the shielding member 130 and the door frame 120 contact.

Figure 17:
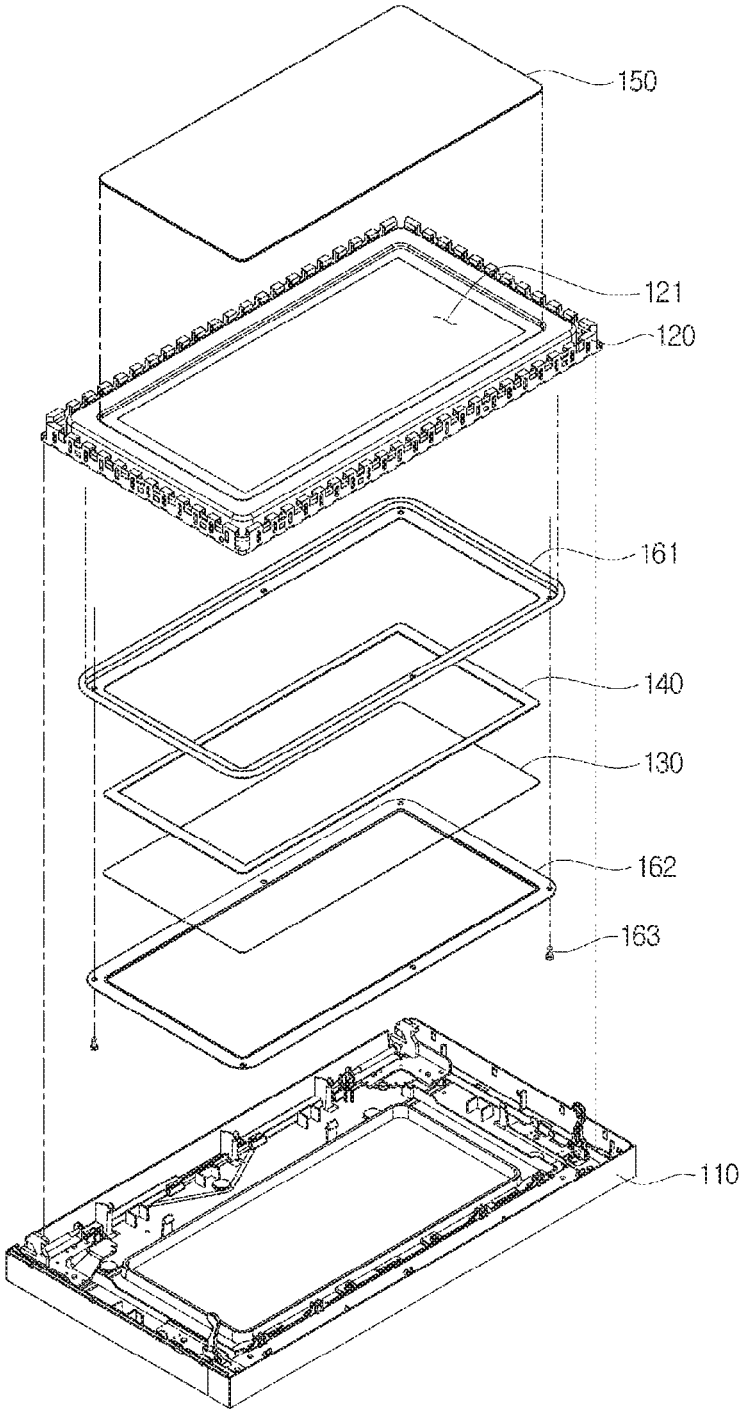
FIG. 17 is an exploded view of a door of a cooking appliance, according to another embodiment of the present disclosure.
Figure 18A:
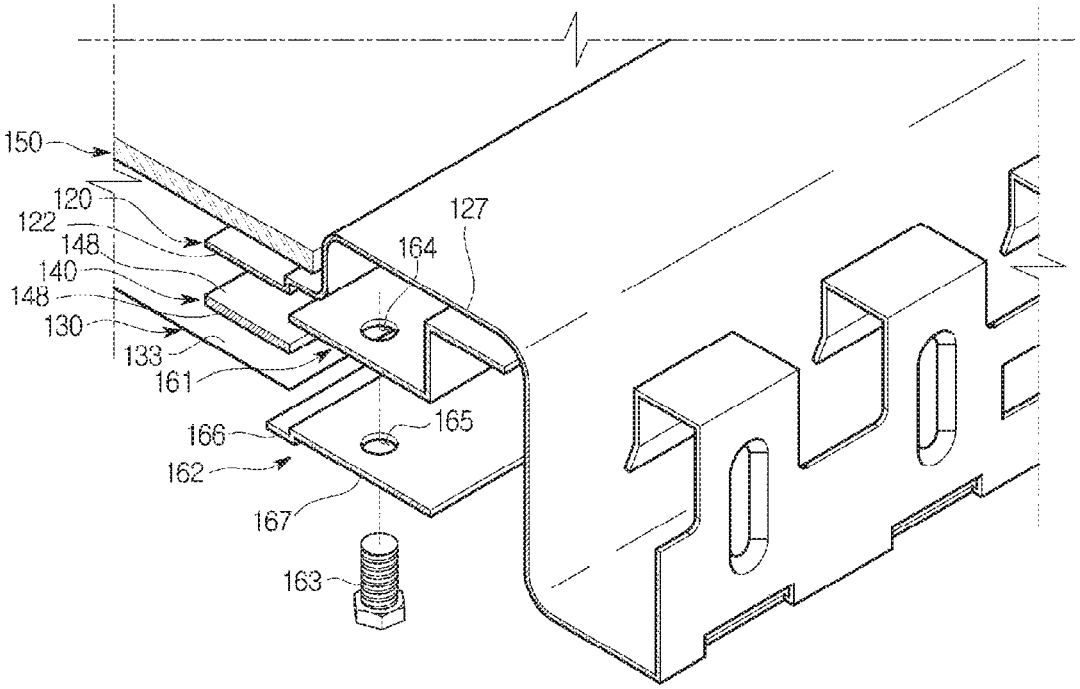
FIGS. 18A and 18B show coupling between a shielding member and a door frame of the door of FIG. 17.
Figure 18B:
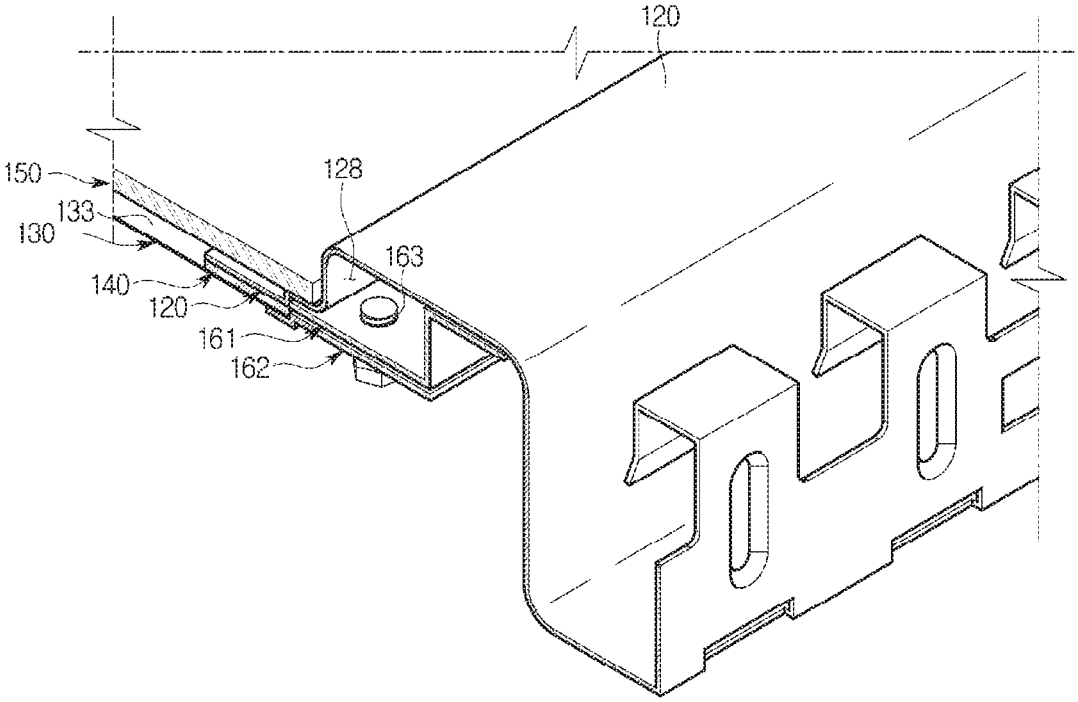

FIG. 17 is an exploded view of a door of a cooking appliance, according to another embodiment of the present disclosure, and FIGS. 18A and 18B show coupling between the shielding member and the door frame of the door of FIG. 17.

The door in the embodiment shown in FIG. 17 further includes a first auxiliary fixing member 161 and a second auxiliary fixing member 162 as compared with the door in the embodiment of FIG. 10. Although the shielding member 130 for blocking electromagnetic waves is arranged between the door frame 120 and the casing 110, it may be arranged on the cooking room 20 of the door frame 120 as shown in FIG. 10. Description of the same components as the embodiment shown FIG. 10 will be omitted herein.

Referring to FIGS. 17, 18A and 18B, the door 100 may include the first auxiliary fixing member 161 and the second auxiliary fixing member 162 to fix the shielding member 130 to the door frame more securely.

The first auxiliary fixing member 161 is fixed on the side of the casing 110 of the door frame 120. The first auxiliary fixing member 161 is combined with the bending portion 127 extending from the border portion 122 of the door frame 120 such that a space 128 may be formed for a fixing screw 163 to be located between the first auxiliary fixing member 161 and the door frame 120. A through hole 164 for the fixing screw 163 to be combined with may be formed in the first auxiliary fixing member 161.

The second auxiliary fixing member 162 may be provided with a first area 166 to press the shielding member 130 and the fixing member 140 and a second area to be combined with the first auxiliary fixing member 161. The first area 166 may form a step with the second area 167. The first area 166 of the second auxiliary fixing member 162 may be formed to overlap the border portion 122 of the door frame 120. Accordingly, when the second auxiliary fixing member 162 is combined with the first auxiliary fixing member 161, the first area 166 of the second auxiliary fixing member 162 receives and presses the shielding member 130 and the fixing member 140 in between the first area 166 and the border portion 122 of the door frame 120 to get the shielding member 130 fixed to the door frame 120 more securely.

A through hole 165 is formed in the second area 167 of the second auxiliary fixing member 162 to be combined with the first auxiliary fixing member 161 through the fixing screw 163. Referring to FIG. 17, an occasion when six fixing screws 163 are applied to the door is shown, but the number of the fixing screws 163 or the fixing positions may be determined as needed.

The door 100 in accordance with the embodiment shown in FIG. 17 may include the screen 150 for protecting the shielding member 130. The screen 150 may be arranged on the side of the cooking room 20 of the door frame 120 not to damage the shielding member 130 by the user when food spatters during cooking in the cooking room 20 or when the door is opened.

Figure 19:
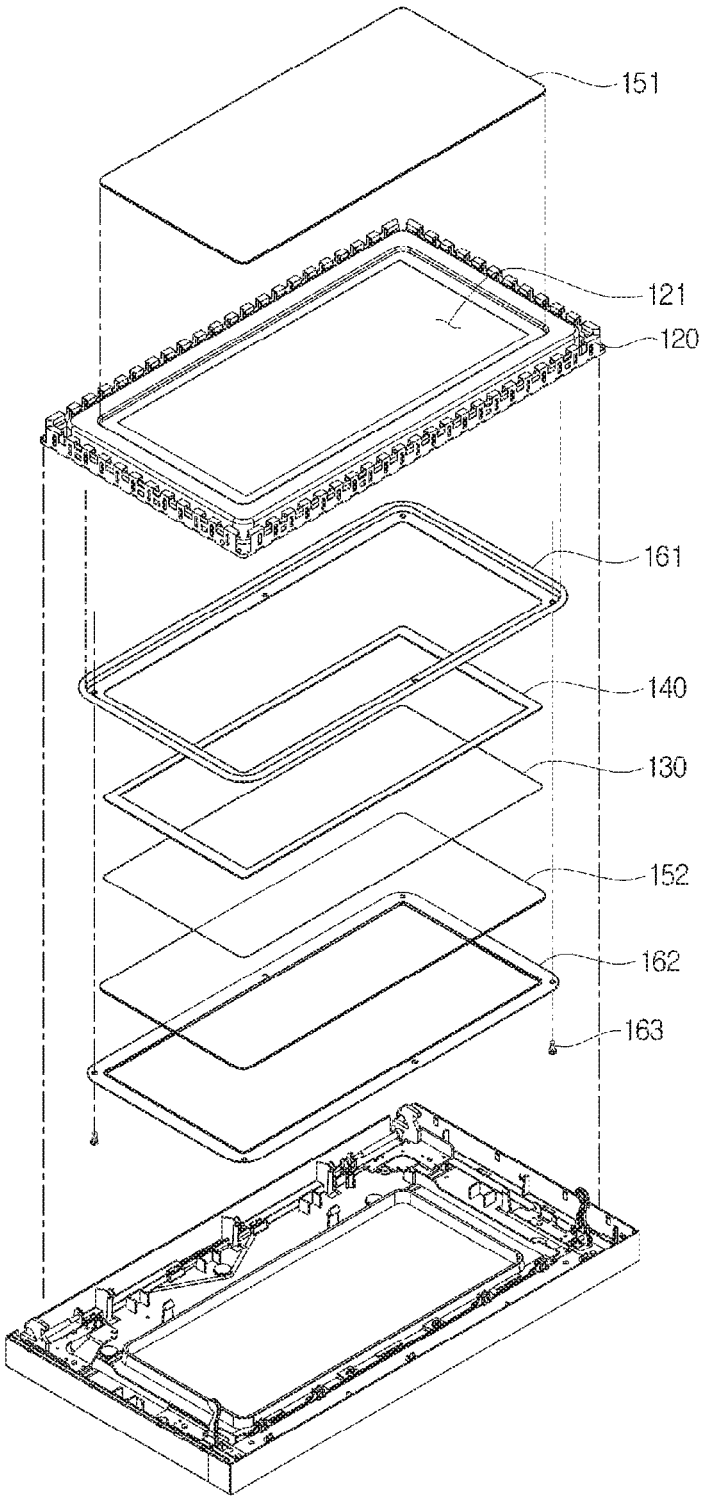
FIG. 19 is an exploded view of a door of a cooking appliance, according to another embodiment of the present disclosure.
Figure 20A:
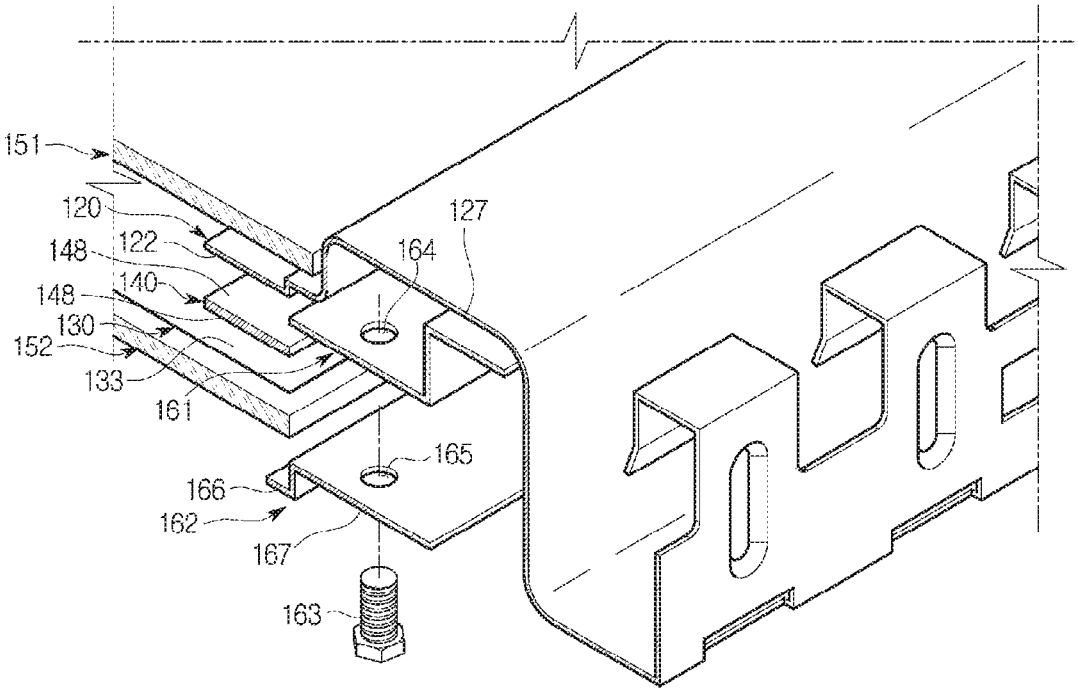
FIGS. 20A and 20B show coupling between a shielding member and a door frame of the door of FIG. 19.
Figure 20B:
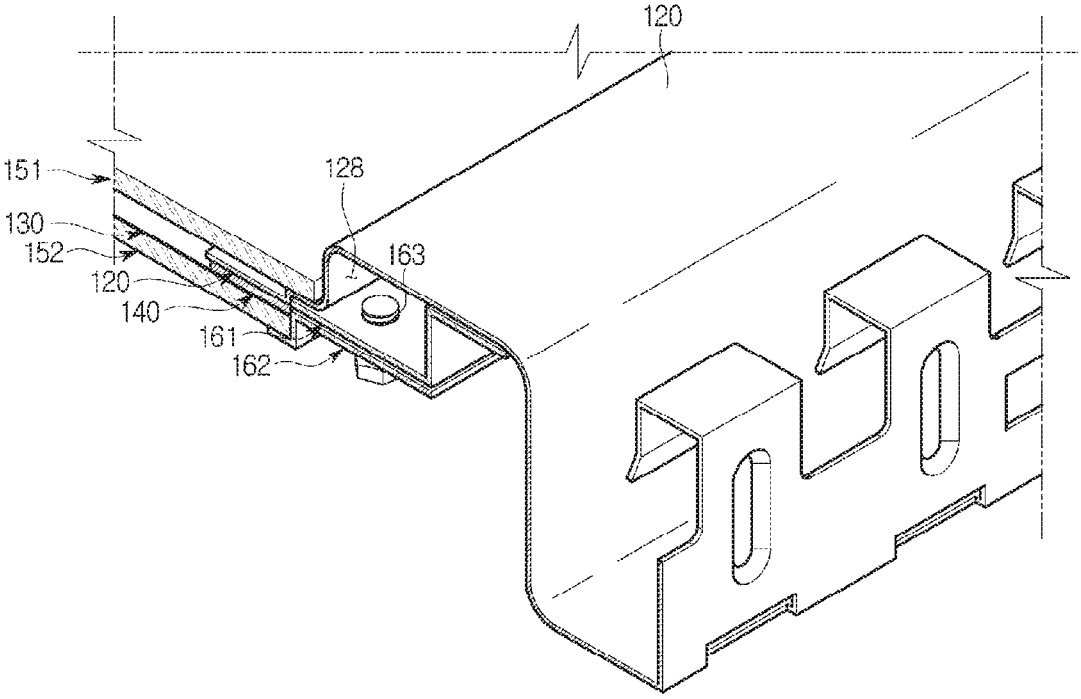

The screen 150 may also be arranged on the side of the casing 110 in addition to the side of the cooking room 20 of the door frame 120, and FIG. 19 is an exploded view of a door of a cooking appliance, according to another embodiment of the present disclosure, and FIGS. 20A and 20B show coupling between a shielding member and a door frame of the door of FIG. 19.

Referring to FIGS. 19, 20A, and 20B, the door 100 of the cooking appliance 1 in accordance with the present disclosure may include at least one screen 150 to protect the shielding member 130, in which case the first screen 151 may be arranged on the side of the cooking room 20 of the door frame 120 and the second screen 152 may be arranged on the side of the casing 110 of the door frame 120.

On the side of the casing 110 of the door frame 120, the shielding member 130, the fixing member 140, and the first and second auxiliary fixing members 161 and 162 provided to get them fixed more securely may be arranged, in which case the second screen 152 may also be securely fixed to the door frame 120 by the first and second auxiliary fixing members 161 and 162.

Specifically, when the second auxiliary fixing member 162 is combined with the first auxiliary fixing member 161, the first area 166 of the second auxiliary fixing member 162 receives and presses the shielding member 130, the fixing member 140, and the second screen 152 in between the first area 166 and the border portion 122 of the door frame 120 to get the shielding member 130 fixed to the door frame 120 more securely.

Although not shown, in order to arrange the shielding member 130 on the side of the cooking room 20 of the door frame 120, the shielding member 130, the fixing member 140, the first auxiliary fixing member 161, the second auxiliary fixing member 162 may be fixed on the side of the cooking room 20 of the door frame 120. In this case, the first screen 151 may be fixed by the first and second auxiliary fixing members 161 and 162.

Figure 21:
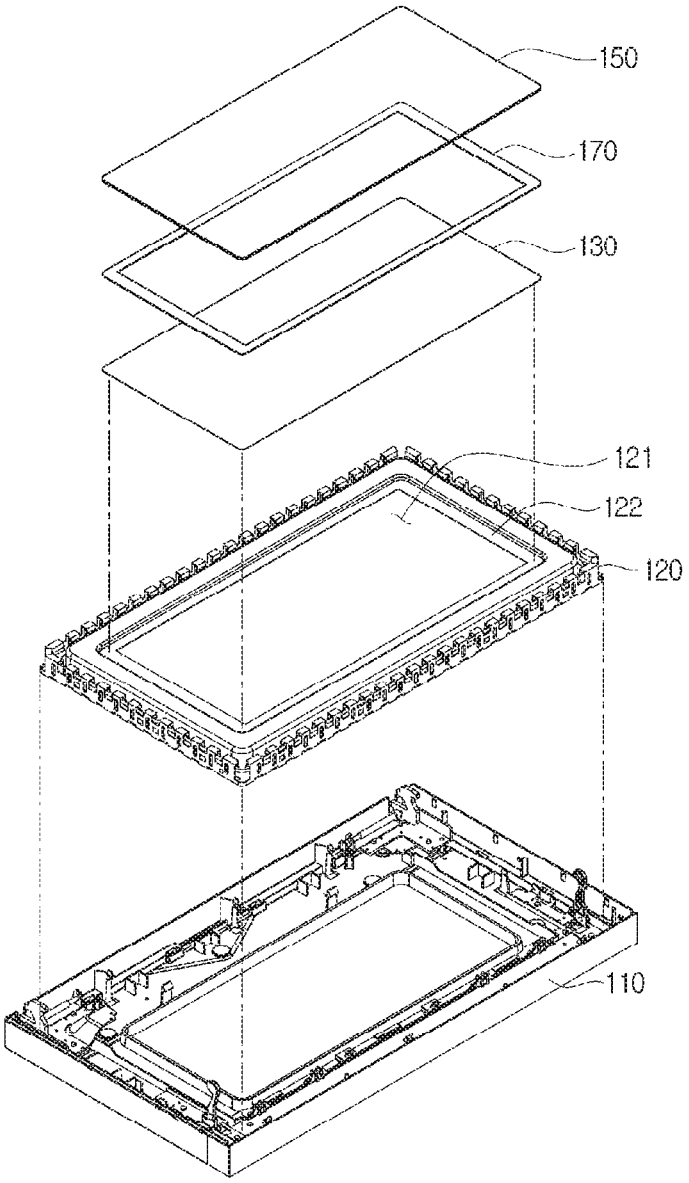
FIG. 21 is an exploded view of a door of a cooking appliance, according to another embodiment of the present disclosure.
Figure 22A:
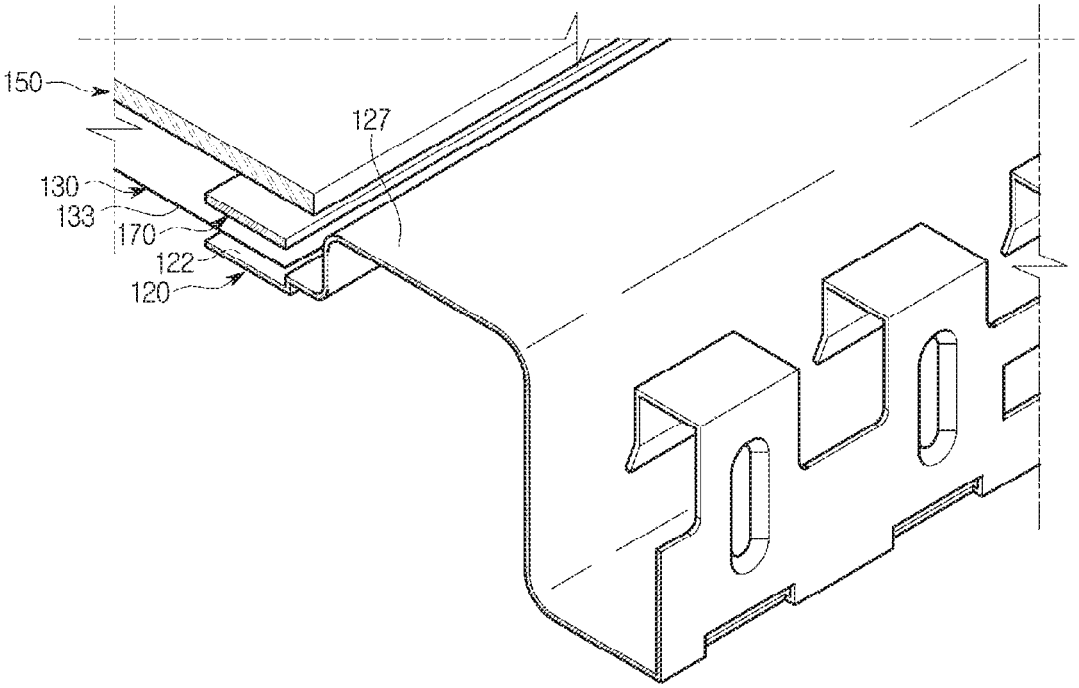
FIGS. 22A and 22B show coupling between a shielding member and a door frame of the door of FIG. 21.
Figure 22B:
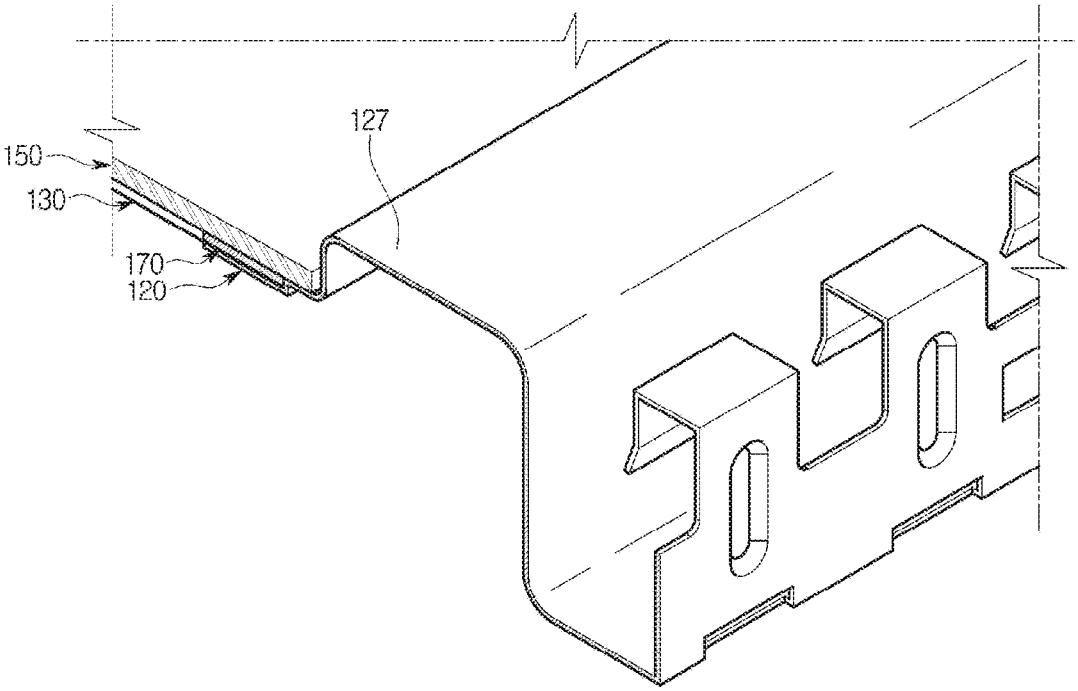

FIG. 21 is an exploded view of a door of a cooking appliance, according to another embodiment of the present disclosure, and FIGS. 22A and 22B show coupling between the shielding member and the door frame of the door of FIG. 21.

Referring to FIGS. 21, 22A and 22B, the door 100 may have the shielding member 130 fixed to the door frame 120 by combining the screen 150 to the door frame 120 without an extra fixing member for fixing the shielding member 130 to the door frame 120.

The blocking layer 133 of the shielding member 130 is arranged to meet the border portion 122 of the door frame 120, and then the screen 150 may be fixed to the bending portion 127 extending from the border portion 122 of the door frame 120 with the shielding member in between.

A buffering member 170 configured to eliminate scattered reflection and absorb shocks may be arranged between the shielding member 130 and the screen 150. The buffering member 170 may have adhesive layers 148 arranged on the side of the shielding member 130 and on the side of the screen 150 to play a role of fixing the shielding member 130 and the screen 150. The buffering member 170 may be formed of a material such as double-sided tape, rubber, plastic molded product, etc.

Although an occasion when the shielding member 130, the buffering member 170, and the screen 150 are arranged on the side of the cooking room 20 of the door frame 120 is shown in FIGS. 21, 22A, and 22B, the shielding member 130, the buffering member 170, and the screen 150 may be arranged on the side of the casing 110 of the door frame 120. Furthermore, if the shielding member 130, the buffering member 170, and the screen 150 are arranged on the side of the casing 110, the extra screen 150 may be further included on the side of the cooking room 20 of the door frame 120.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

The invention claimed is:

1. A cooking appliance comprising:

a main body including a cooking room; and a door arranged on a front of the main body and configured to open and close the cooking room, wherein the door comprises:

a door frame including an opening formed to see into the cooking room and a conductive border portion around the opening, a shielding member arranged to cover the opening, the shielding member including a conductive blocking layer configured to block electromagnetic waves and a first through hole, and a fixing frame arranged to combine the door frame and the shielding member, and including a coupling protrusion that protrudes through the first through hole of the shielding member to combine with the door frame, and wherein the shielding member is arranged in a manner such that the conductive blocking layer contacts the conductive border portion of the door frame to be electrically connected to the door frame.

2. The cooking appliance of claim 1, wherein the shielding member includes the conductive blocking layer formed with a conductive material to block electromagnetic waves applied onto a transparent plastic film or panel.

3. The cooking appliance of claim 1, wherein the shielding member includes the conductive blocking layer formed with a conductive material to block electromagnetic waves applied onto a transparent glass film or panel.

4. The cooking appliance of claim 1, wherein the fixing frame is formed in a figure corresponding to the conductive border portion of the door frame.

5. The cooking appliance of claim 4, wherein the door frame includes a coupled portion arranged in the conductive border portion and combined with the coupling protrusion of the fixing frame.

6. The cooking appliance of claim 5, wherein a plurality of coupling protrusions of the fixing frame are arranged along the conductive border portion of the door frame where the shielding member and the door frame join, and an interval between the plurality of the coupling protrusions is equal to or less than 50 mm.

7. The cooking appliance of claim 5, wherein:

the coupling protrusion of the fixing frame comprises a welding projection protruding to the shielding member perpendicularly to the fixing frame to enable a welding position to be checked, and to be combined with the coupled portion of the door frame, the welding projection passes through the first through hole of the shielding member to be combined with the coupled portion of the door frame, and the coupled portion of the door frame comprises a conductive welded portion allowing the welding projection to be welded.

8. The cooking appliance of claim 5, wherein:

the coupling protrusion of the fixing frame comprises a pressing portion configured to apply pressure toward the shielding member perpendicularly to the fixing frame to be combined with the coupled portion of the door frame, the pressing portion passes through the first through hole of the shielding member to be combined with the coupled portion of the door frame, and the coupled portion of the door frame comprises a pressed portion pressed with the pressing portion of the fixing frame.

9. The cooking appliance of claim 5, wherein:

the coupling protrusion of the fixing frame comprises a burring portion including a burring hole and a side wall surrounding the burring hole and extending to the shielding member perpendicularly to the fixing frame, the burring portion passes through the first through hole of the shielding member to be combined with the coupled portion of the door frame, and the coupled portion of the door frame comprises a second through hole formed for the burring portion to pass through.

10. The cooking appliance of claim 9, wherein:

the burring portion of the fixing frame penetrates the first through hole and the second through hole formed in the shielding member and the door frame, and the side wall of the burring portion penetrating and protruding from the second through hole is bent outward in a radial direction of the burring hole to form a curling portion.

11. The cooking appliance of claim 5, wherein:

the door comprises at least one screen to protect the shielding member; and the at least one screen comprises a first screen arranged to cover the coupling protrusion of the fixing frame.

12. The cooking appliance of claim 11, wherein the at least one screen comprises a second screen arranged on an opposite side of the shielding member from the door frame to protect a side of the shielding member, on which the first screen is not arranged.

* * * * *